US007598477B2

(12) United States Patent
Smith

(10) Patent No.: US 7,598,477 B2
(45) Date of Patent: Oct. 6, 2009

(54) VACUUM MUFFLE QUENCH FURNACE

(76) Inventor: Guy Smith, 11883 Pearl Rd., Apt. 207, Strongsville, OH (US) 44136

( * ) Notice: Subject to any disclaimer, the term of this patent is extended or adjusted under 35 U.S.C. 154(b) by 472 days.

(21) Appl. No.: 11/051,150

(22) Filed: Feb. 7, 2005

(65) Prior Publication Data

US 2006/0175316 A1 Aug. 10, 2006

(51) Int. Cl.
*F27B 5/05* (2006.01)
*F27B 5/10* (2006.01)
*F27B 5/14* (2006.01)

(52) U.S. Cl. ..... 219/390; 219/400; 266/255; 266/259; 373/111; 373/113

(58) Field of Classification Search ..... None
See application file for complete search history.

(56) References Cited

U.S. PATENT DOCUMENTS 1,825,790 A * 10/1931 Hansen ..... 432/206
2,032,209 A * 2/1936 Harsch ..... 266/252
2,093,212 A * 9/1937 Robertson ..... 432/152
2,805,054 A * 9/1957 Hill ..... 432/206
2,849,222 A * 8/1958 Senger ..... 432/249
3,188,068 A * 6/1965 Schmidt ..... 432/206
3,301,541 A * 1/1967 Ipsen ..... 266/250
3,608,187 A * 9/1971 Shutt ..... 228/102
4,195,820 A * 4/1980 Berg ..... 266/87
4,278,421 A * 7/1981 Limque et al. ..... 432/152
4,610,435 A * 9/1986 Pfau et al. ..... 266/250
4,709,904 A 12/1987 Schmetz
4,970,372 A 11/1990 Fleiter et al.
5,121,903 A 6/1992 Ripley et al.
5,303,904 A * 4/1994 Kemp ..... 266/252
5,630,322 A * 5/1997 Heilmann et al. ..... 62/63
5,722,825 A * 3/1998 Edenhofer ..... 432/138
6,151,447 A * 11/2000 Moore et al. ..... 392/418
6,533,991 B1 3/2003 Moller
6,632,302 B2 * 10/2003 Fisher et al. ..... 148/640
6,756,566 B2 * 6/2004 Moller ..... 219/400
6,821,114 B2 11/2004 Kisoda

FOREIGN PATENT DOCUMENTS

GB 2136938 A * 9/1984
JP 62013537 A * 1/1987

* cited by examiner

*Primary Examiner*—Joseph M Pelham
(74) *Attorney, Agent, or Firm*—Lindon & Lindon; James Lindon

(57) ABSTRACT

A vacuum furnace adapted to cool a load. The vacuum furnace has one or more means for cooling a fluid and a muffle substantially containing the load. The fluid flows in a substantially unidirectional flow substantially within the muffle.

17 Claims, 39 Drawing Sheets

VACUUM MUFFLE QUENCH FURNACE

BACKGROUND OF THE INVENTION

Many furnaces used to heat and/or cool a load within specified tolerances can produce inconsistent results. There is a long-felt need for an improved furnace, including an improved vacuum furnace.

SUMMARY OF THE INVENTION

The above advantages as well as other advantages not specifically enumerated are achieved by a vacuum furnace adapted to cool a load. The vacuum furnace has one or more means for cooling a fluid and a muffle substantially containing the load. The fluid flows in a substantially unidirectional flow substantially within the muffle. There is also provided a vacuum furnace for heating a load. The vacuum furnace has one or more means for heating the load, and a muffle substantially containing the load. The one or more means for heating the load is substantially external to the muffle. There is also provided a method for cooling a load in a vacuum furnace having the steps of providing the load in a muffle. The method also includes applying a fluid across the load in a substantially unidirectional flow substantially within the muffle.

Various advantages of this invention will become apparent to those skilled in the art from the following detailed description of the preferred embodiment, when read in light of the accompanying drawings.

DETAILED DESCRIPTION OF THE INVENTION

Figure 1:
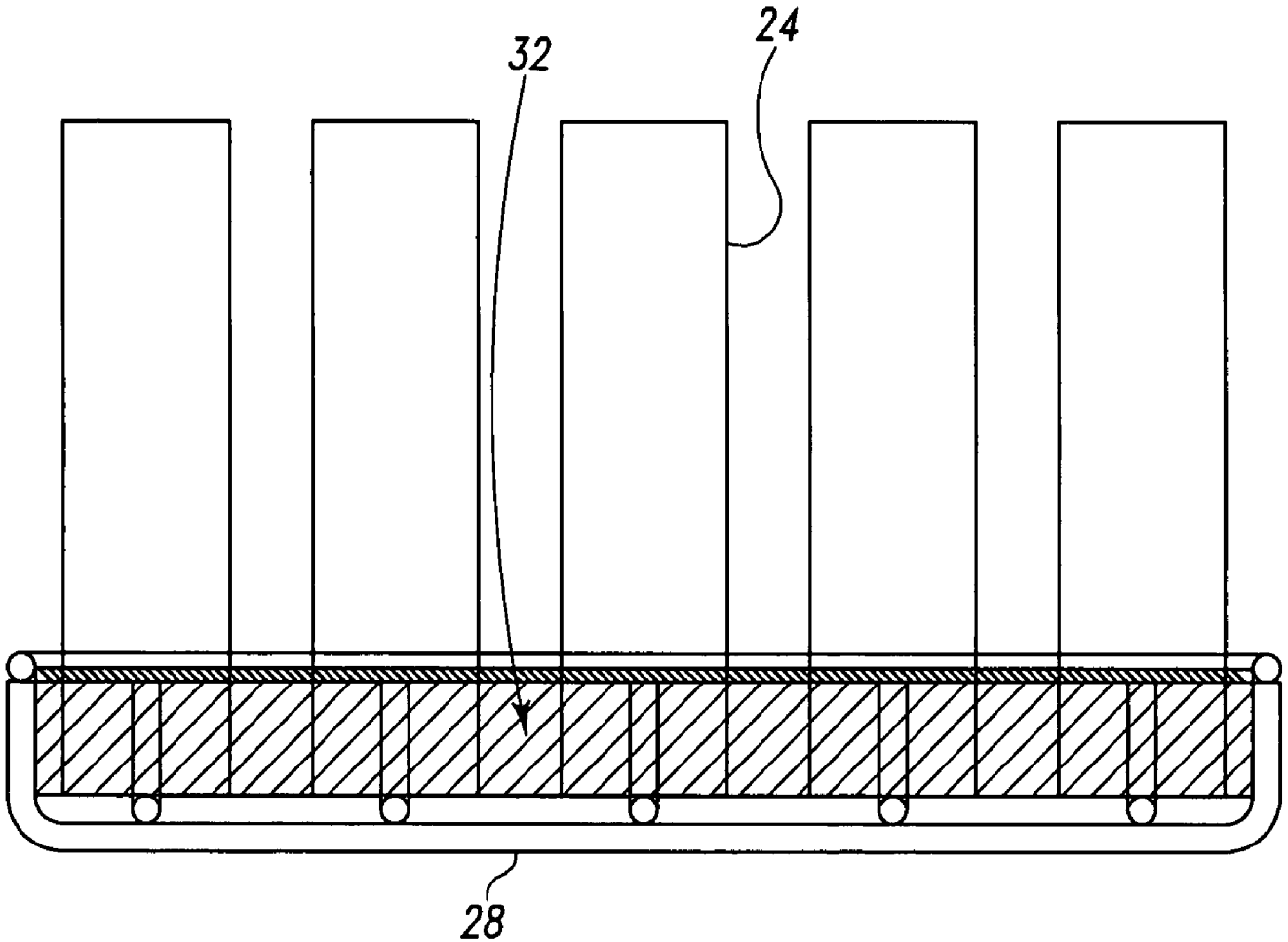
FIG. 1 is a view in elevation of a load to be heated and/or cooled in accordance with this invention.
Figure 2:
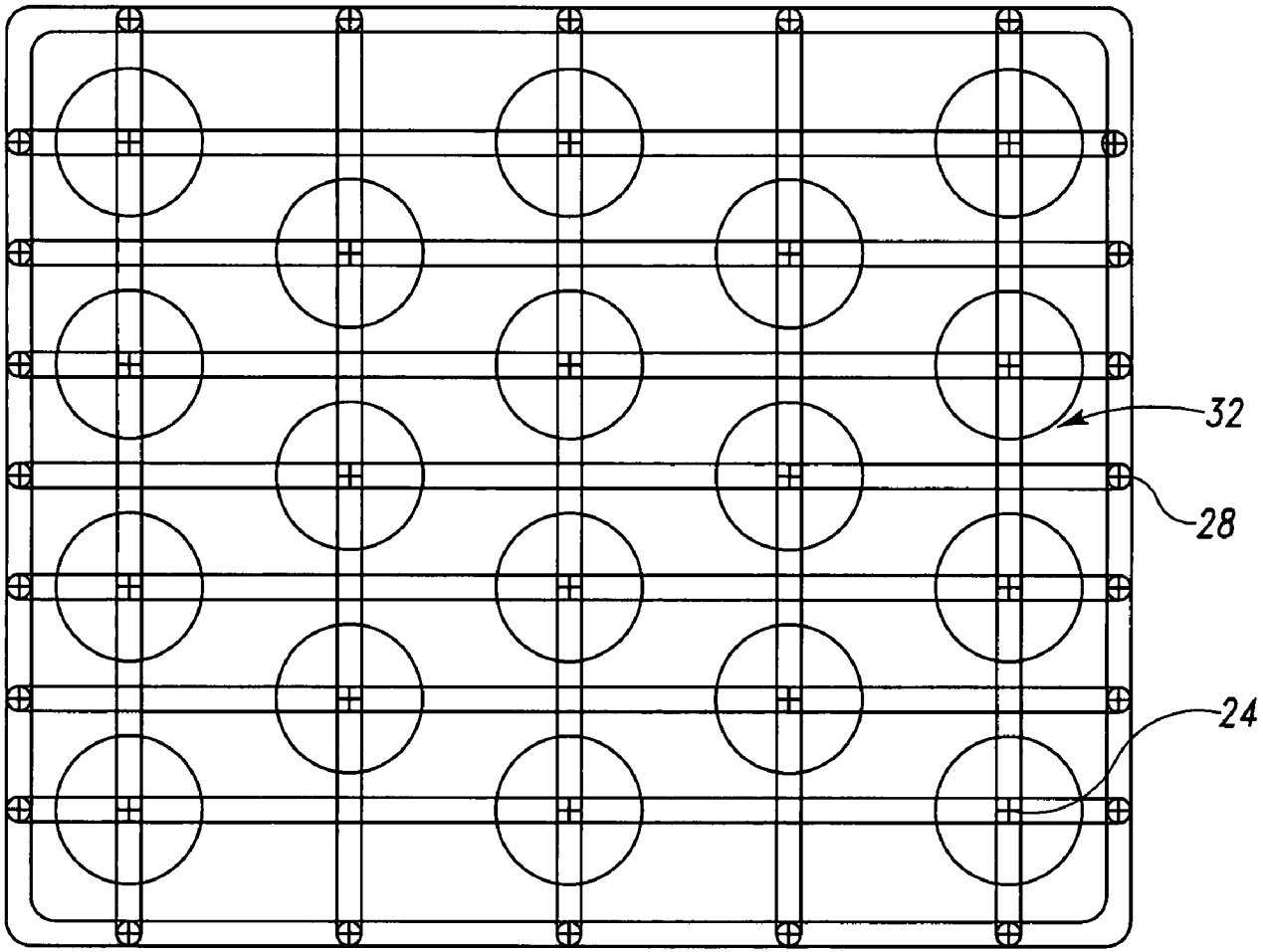
FIG. 2 is a top plan view in of the load of FIG. 1.

Preliminarily, it should be noted that certain terms used herein, such as for example "left", "right", "front", "rear", "top", "bottom", and the like are used to facilitate the description of the invention. Unless otherwise specified or made apparent by the context of the discussion, such terms and other directional terms should be interpreted with reference to the figure(s) under discussion. Such terms are not intended as a limitation on the position in which the invention or components may be used. Indeed, it is contemplated that the components of the invention may be orientated for use as desired. Likewise, numerical terms such as for example "first", and "second" are not intended as a limitation or to imply a sequence, unless otherwise specified or made apparent by the context of the discussion.

There is a need for consistent heating and/or cooling a load within variance or tolerance. For example, aerospace applications may require a five degree variance in the heating and/or cooling of a load within a hot zone. The term "load" is understood to include a quantity of material placed into a device, such as for example a furnace, at one time. A load may include work pieces or parts to be heated, cooled, or otherwise treated. The load may be so treated in a hot zone. The term "hot zone" with respect to a furnace is understood to include a region or area set off from those surrounding or adjoining. In general, the less time required to cool a load, the stronger or harder that load will be. The heating and/or cooling may be done by flowing a suitable fluid over and/or through the load. The term "fluid" is understood to include any suitable substance, including any suitable liquid and/or gas, that is capable of flowing. Non-limiting examples of suitable fluids which may be employed with the present invention include inert gases, hydrogen, nitrogen, helium, krypton, argon, neon, and the like.

Referring now to the drawings, there is shown a furnace, indicated generally at 20, having a load 24. The furnace 20 shown in FIGS. 3, 4, 5, 7, and 8 are oriented generally horizontally. The illustrated load 24 is shown as a series, five in particular, of cylindrical members in a rod frame basket 28 with a wire mesh liner 32.

Figure 3:
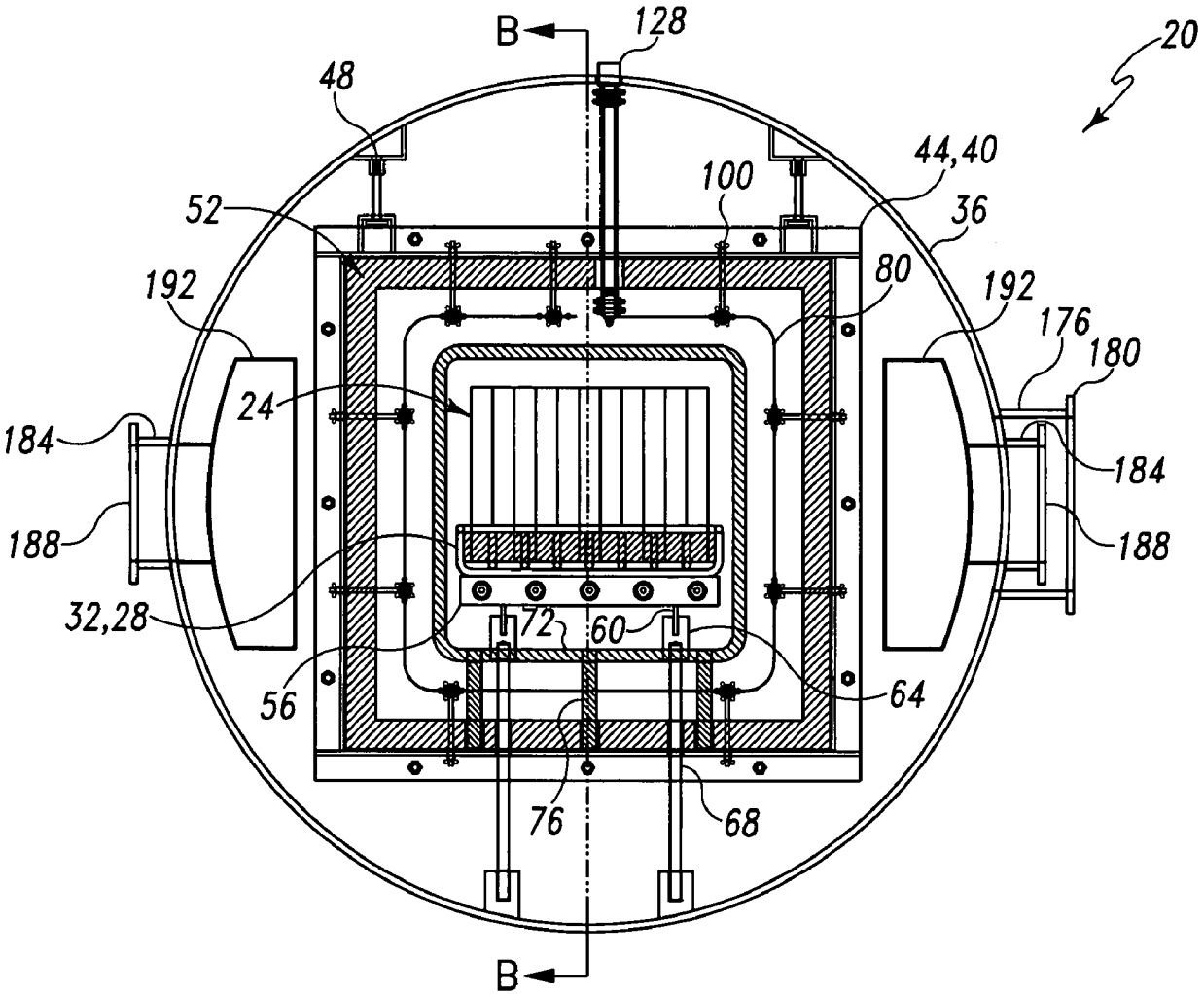
FIG. 3 shows an end view of a vacuum furnace oriented generally horizontally according to the invention and shown along line A-A of FIG. 4.

Referring now primarily to FIG. 3, the illustrated furnace 20 is a vacuum furnace. The illustrated furnace 20 includes a vacuum chamber wall 36 which generally surrounds a hot zone shell 40 and an angle iron frame 44. The vacuum chamber wall 36 defines a chamber within. A hot zone shell hanger assembly 48 is provided to suspend and/or support the hot zone shell 40 and the angle iron frame 44. The hot zone shell hanger assembly 48 is shown secured to the vacuum chamber wall 36. A layer of thermal insulation 52 is also provided as shown.

The rod frame basket 28 is shown supported by a serpentine grid 56. The serpentine grid 56 is shown supported by two hearth bars 60, though any suitable number may be employed. The hearth bars 60 are shown along the length of the serpentine grid 56. The hearth bars 60 are shown supported by hearth post caps 64. The hearth post caps 64 are shown supported by hearth posts 68. A refractory metal may be employed for the construction of the hearth bars 60, the hearth post caps 64, and the hearth posts 68.

A muffle 72 is shown. The terms "muffle" and/or "muffle assembly" are understood in include any suitable structure(s) or means to substantially wrap up, conceal, protect, and/or envelop an item, such as for example a load. The illustrated muffle 72 is a refractory metal muffle. A plurality of muffle support bars 76, specifically three, are provided to support the muffle 72, though any suitable number may be employed.

Figure 16:
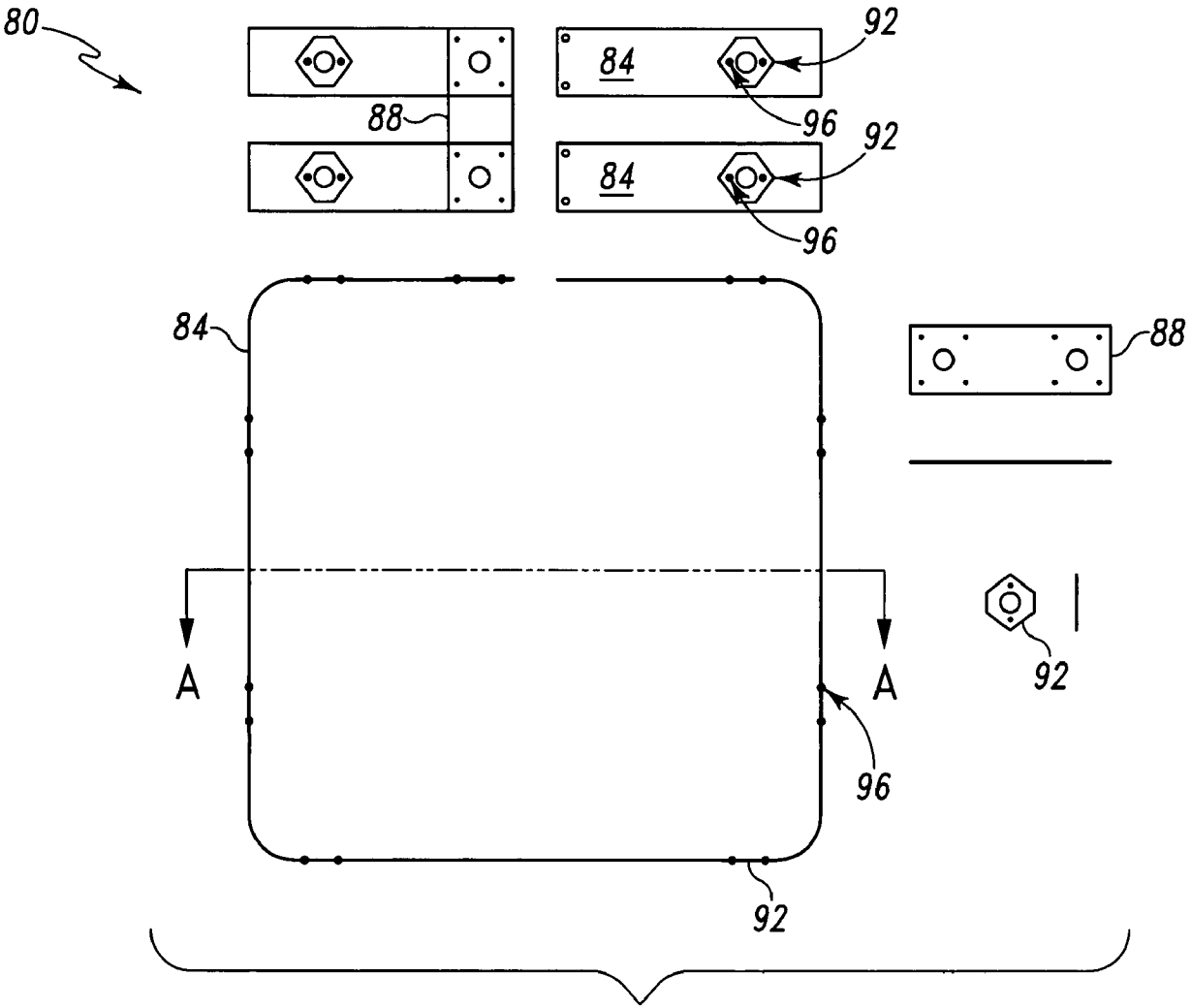
FIG. 16 shows heating element assembly details.

A plurality of heating element assemblies 80, specifically six, are provided as heat producing means. The heating element assemblies 80, seen in detail in FIG. 16, are means for heating a fluid. Each of the heating element assemblies 80 shown include a heating element 84. The illustrated heating element 84 is a generally quadrilateral member with generally rounded corners. The heating element 84 may be supplied with suitable heating element jumper plate 88, current compensator cap 92 and rivets 96 as required.

Figure 12:
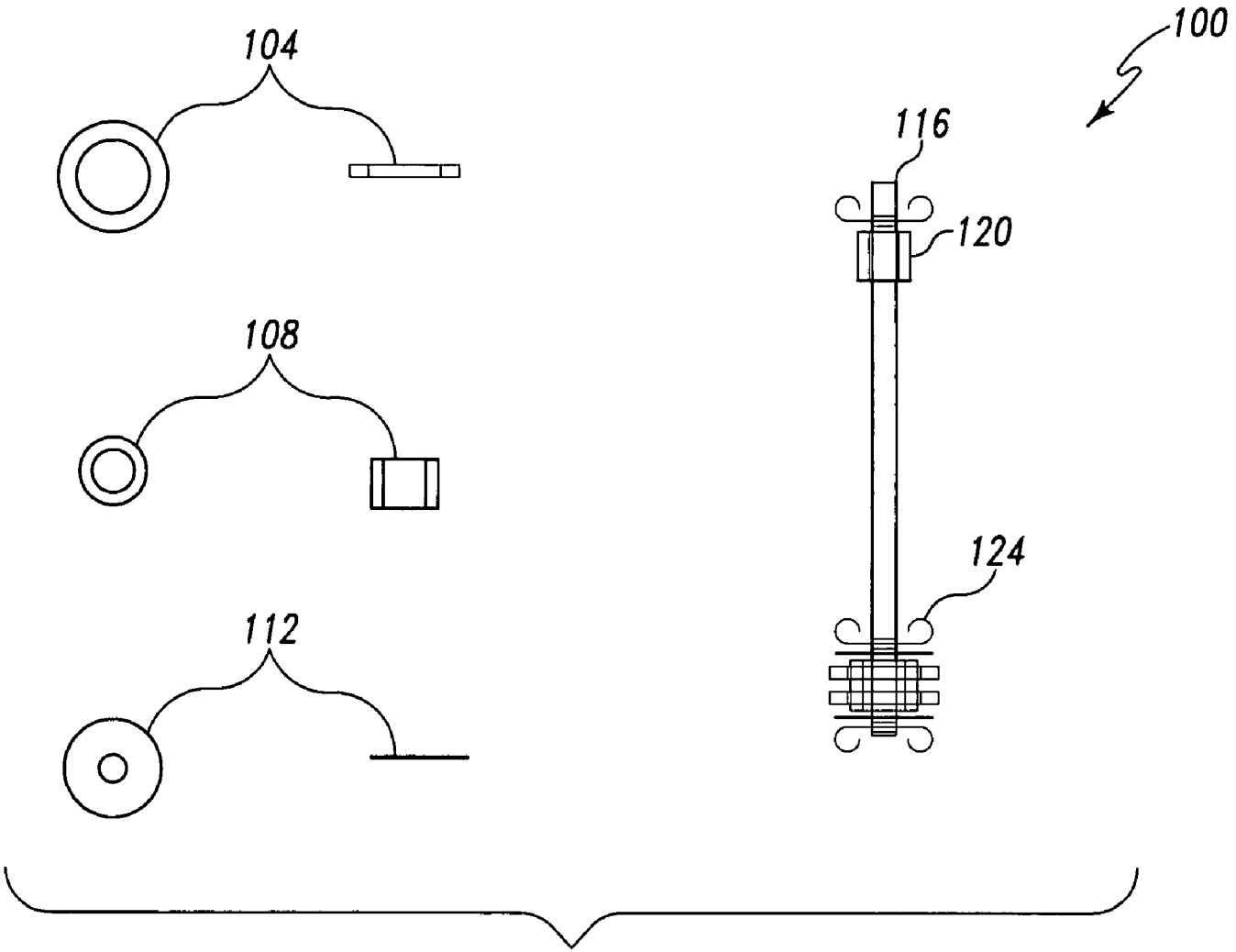
FIG. 12 shows a heating support assembly.
Figure 13:
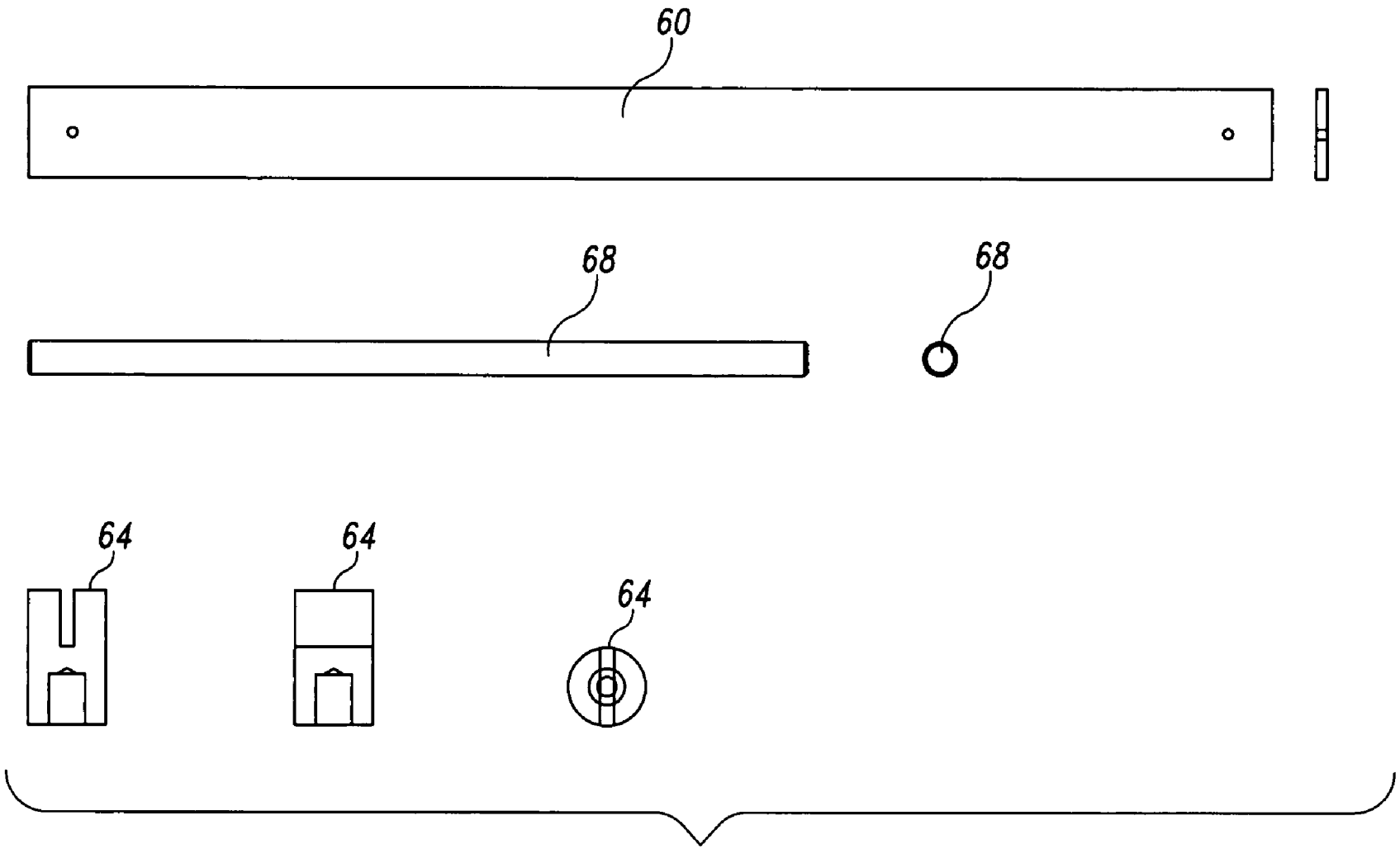
FIG. 13 shows hearth support elements.

Each heating element assembly 80 is shown operatively connected with a heating element support assembly 100, seen in detail in FIG. 12. The term "operatively connected" is understood to include a linking together of the portions under consideration and may include a physical engagement and/or a functional or operational connection. The illustrated heating element support assembly 100 includes a ceramic ring outer insulator 104 and a ceramic tube inner insulator 108. The ceramic ring outer insulator 104 and the ceramic tube inner insulator 108 may be a high purity alumina or other suitable material. The illustrated heating element support assembly 100 further includes a washer 112 and a generally smooth rod 116. The illustrated washer 112 and the rod 116 may be constructed with a refractory metal or other suitable material. The illustrated heating element support assembly 100 further includes a schedule 80 pipe section 120, which may be constructed with stainless steel or other suitable material, and a wire loop 124 which may be constructed with a refractory metal or other suitable material.

Figure 14:
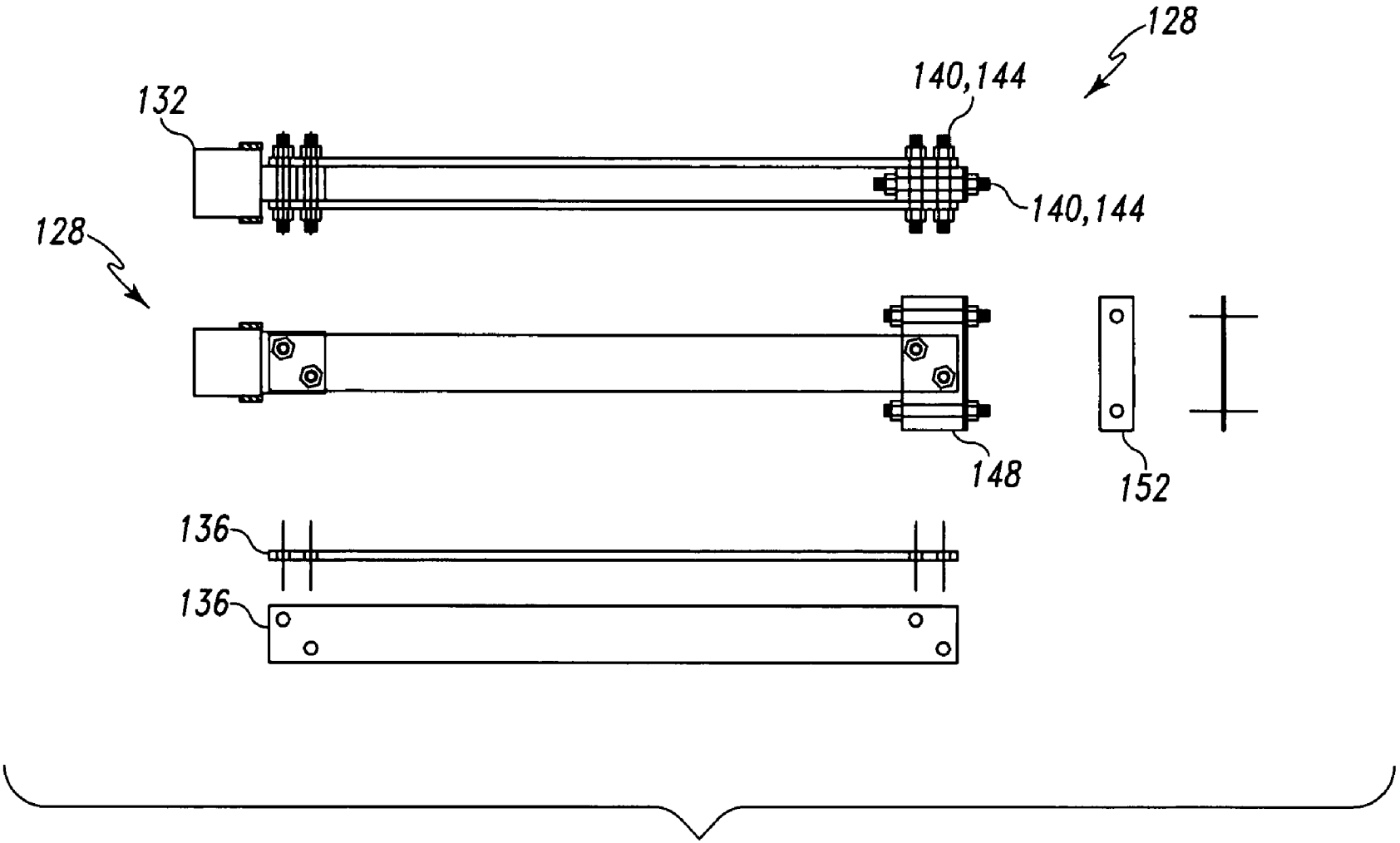
FIG. 14 shows power feed assembly details.

Each heating element assembly 80 is also shown operatively connected with an element power feed assembly 128, seen in detail in FIG. 14. The illustrated element power feed assembly 128 includes a chamber power feed lug 132 which may be constructed with copper or other suitable material and a Power Feed Bus Bar 136 which may be constructed with a refractory metal or other suitable material. The illustrated element power feed assembly 128 also includes a suitable number of studs 140 and hex nuts 144, both of which may be constructed with a refractory metal or other suitable material. The illustrated element power feed assembly 128 also includes a suitable power feed terminal block 148 and element tie strap 152, both of which may be constructed with a refractory metal or other suitable material.

Figure 23:
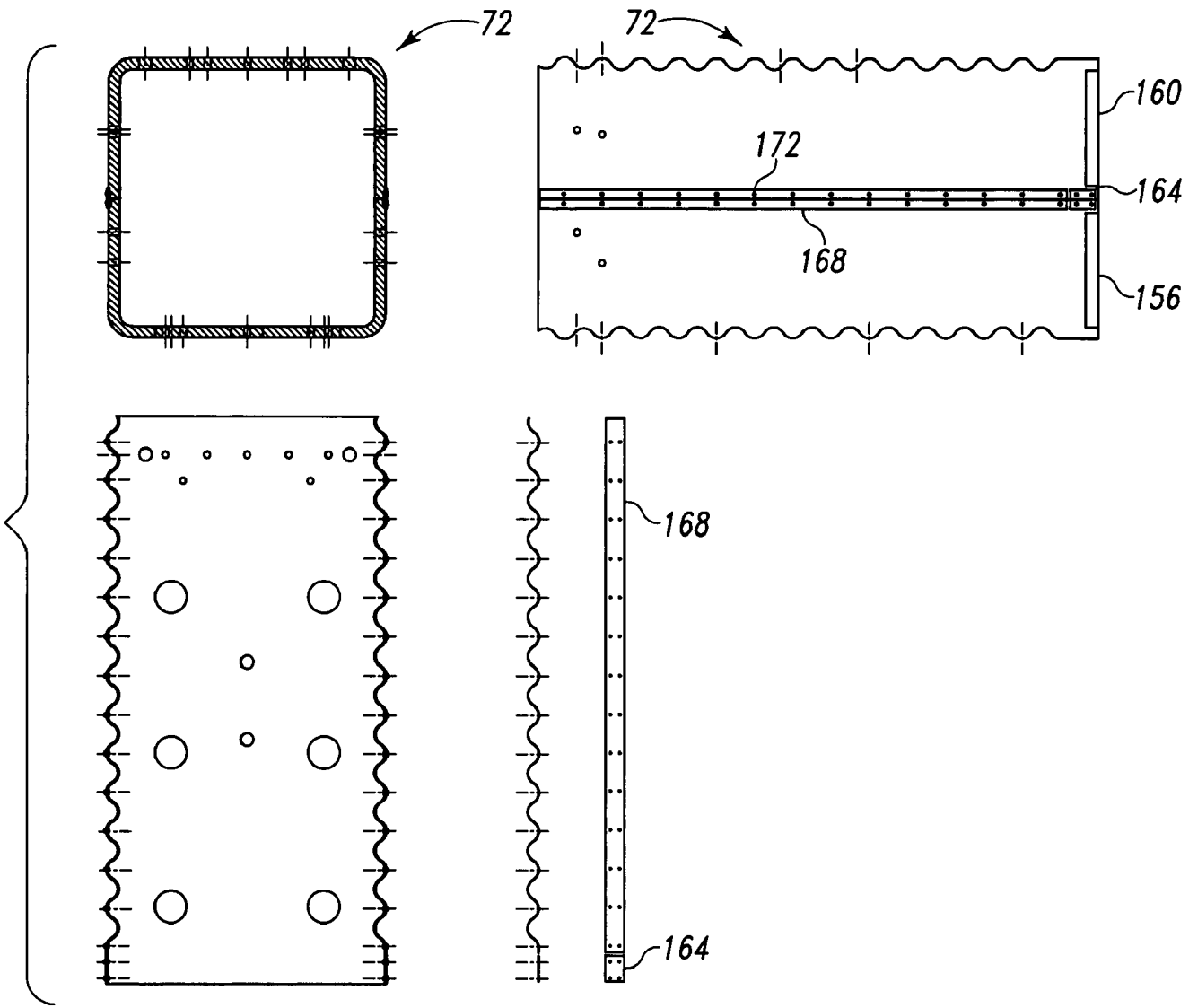
FIG. 23 shows an inner generally corrugated muffle assembly.
Figure 24:
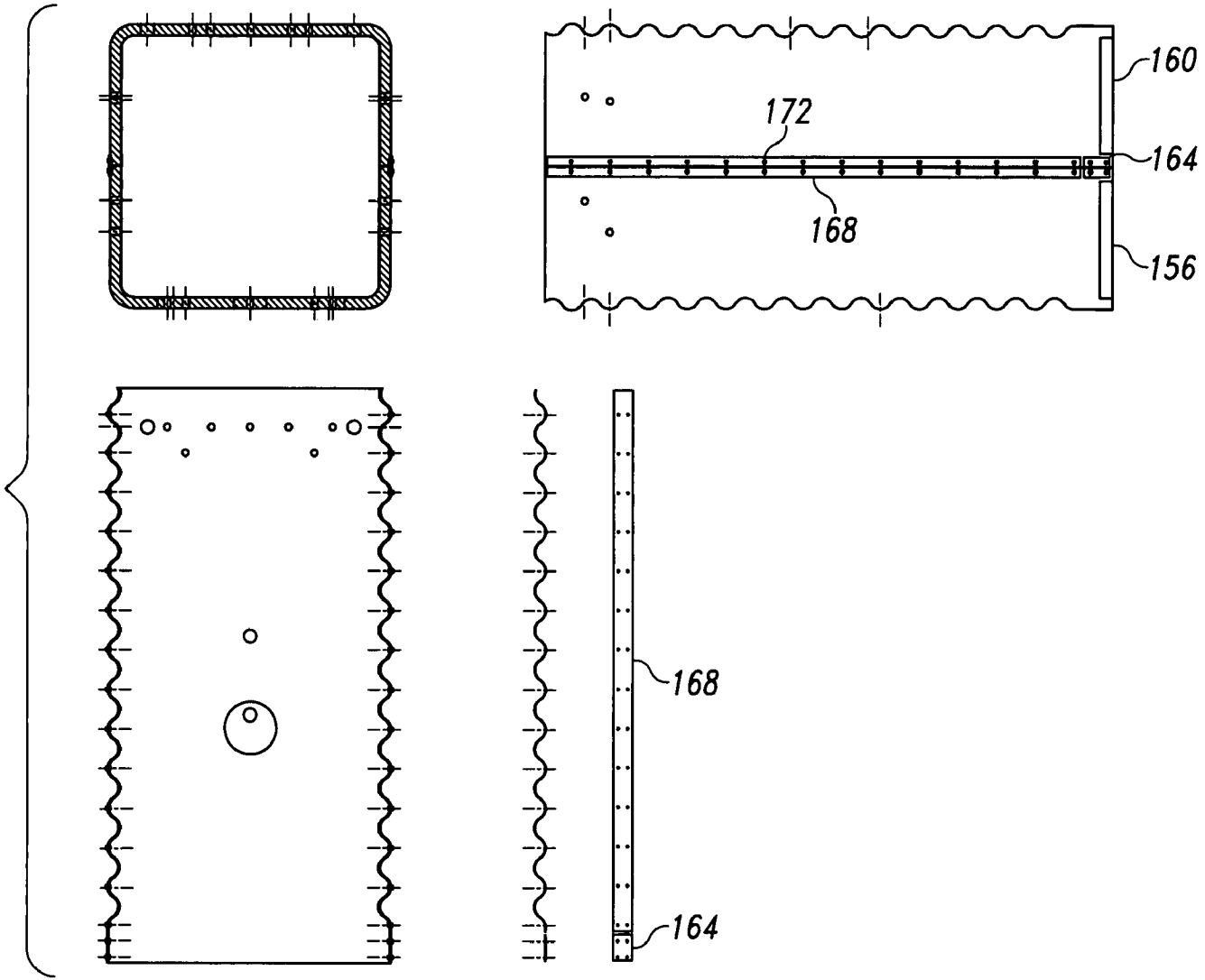
FIG. 24 shows a turntable muffle assembly.
Figure 25:
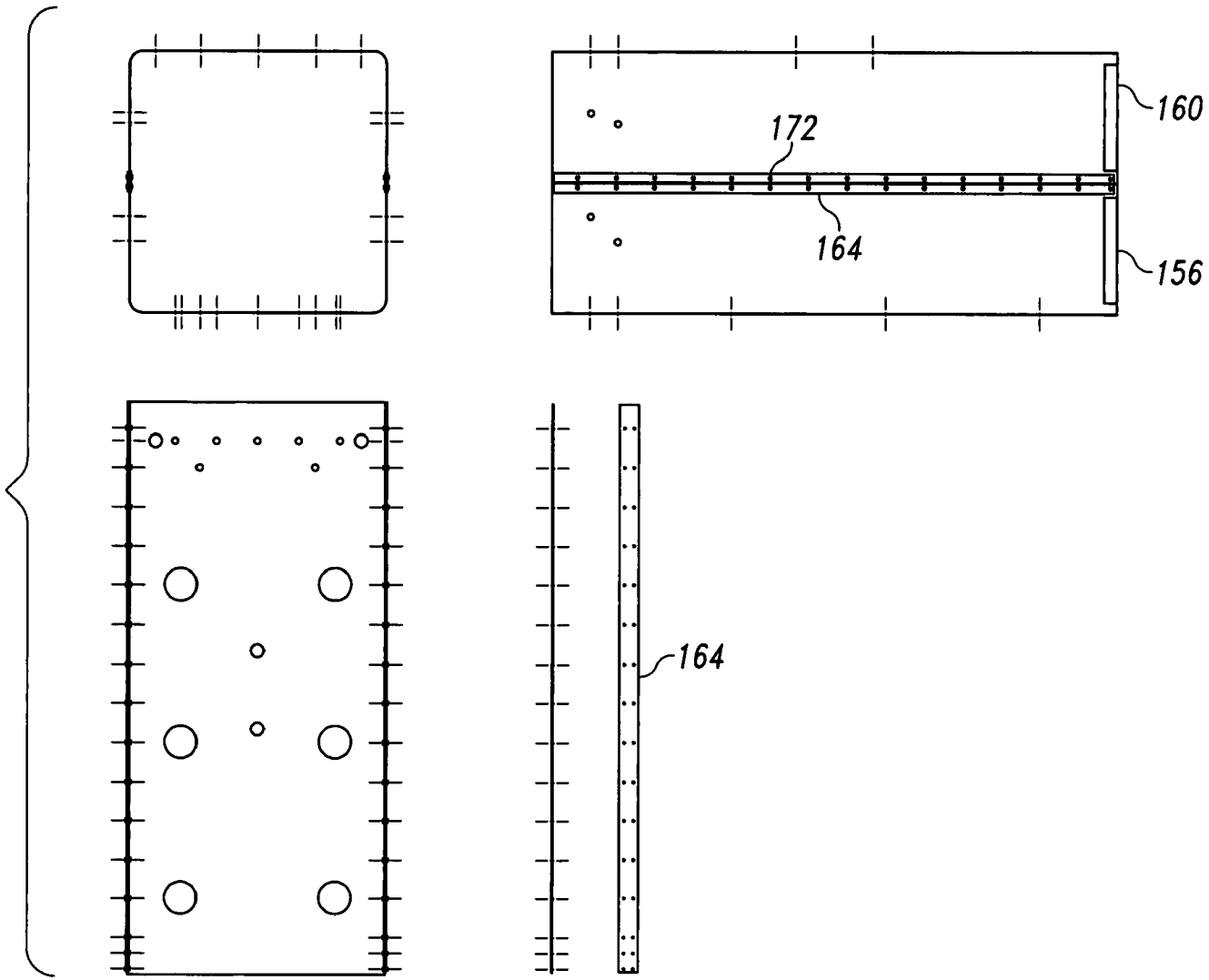
FIG. 25 shows a straight muffle assembly.

The illustrated muffle 72, seen in detail in FIG. 23, may be constructed with a refractory metal or other suitable material. The illustrated muffle 72 includes a corrugated muffle bottom section 156 and a corrugated muffle top section 160. The illustrated muffle 72 also includes a muffle joiner strip straight 164 and muffle joiner strip corrugated 168. A suitable number and type of rivets 172 may be employed as shown or otherwise.

Referring now to the right side of FIG. 3, a hot gas outlet pipe 176 and hot gas outlet pipe flange 180 are provided. Both the left side and the right side of FIG. 3 show a cold gas inlet pipe 184 an a cold gas inlet pipe flange 188. Likewise, the left side and the right side of FIG. 3 show a cold gas manifold 192. The terms "hot gas" and "cold gas" are terms describing temperature in relative terms.

Figure 15:
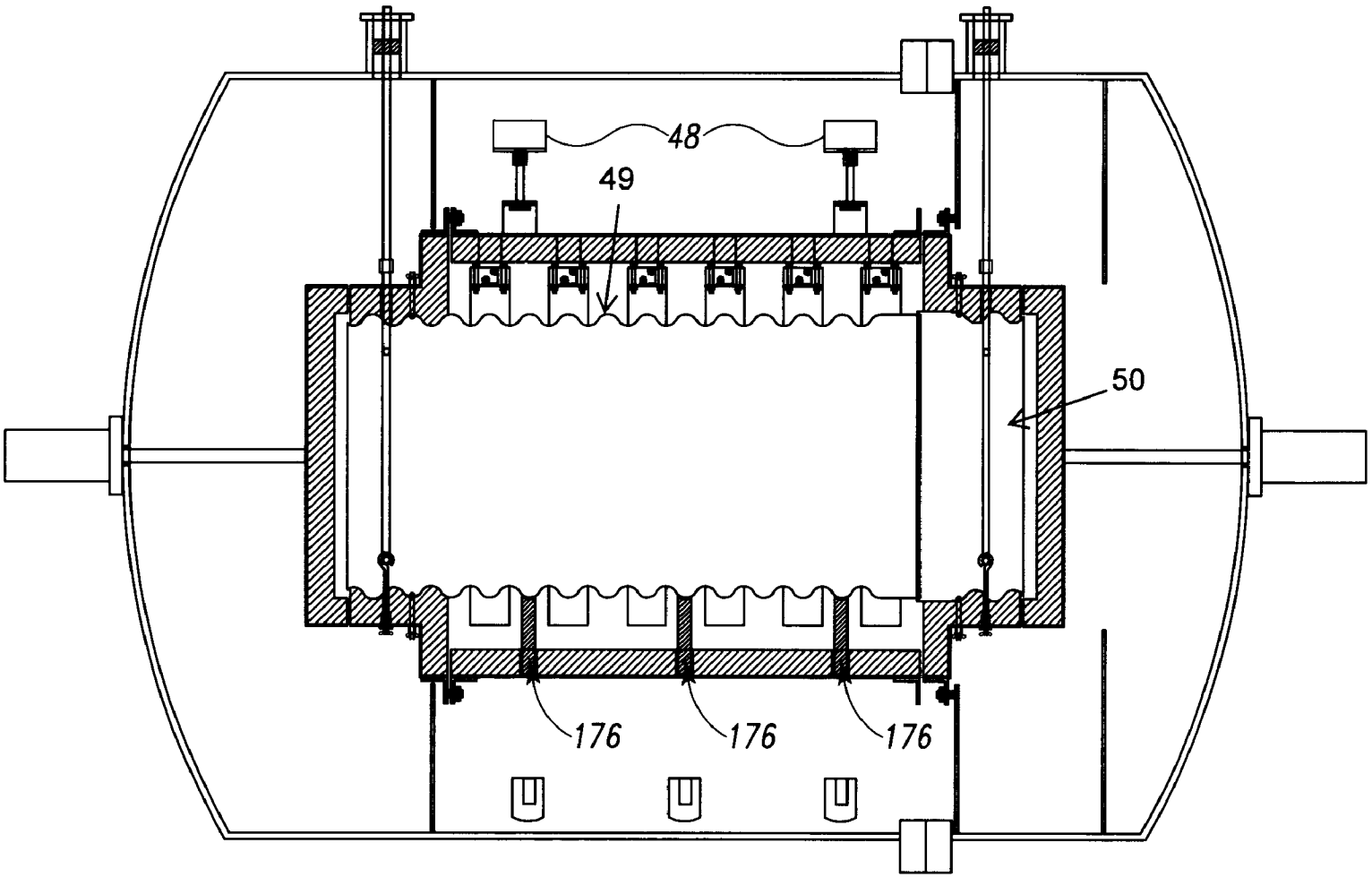
FIG. 15 shows muffle and shell support layout with an inner muffle assembly and an outer muffle assembly.
Figure 17:
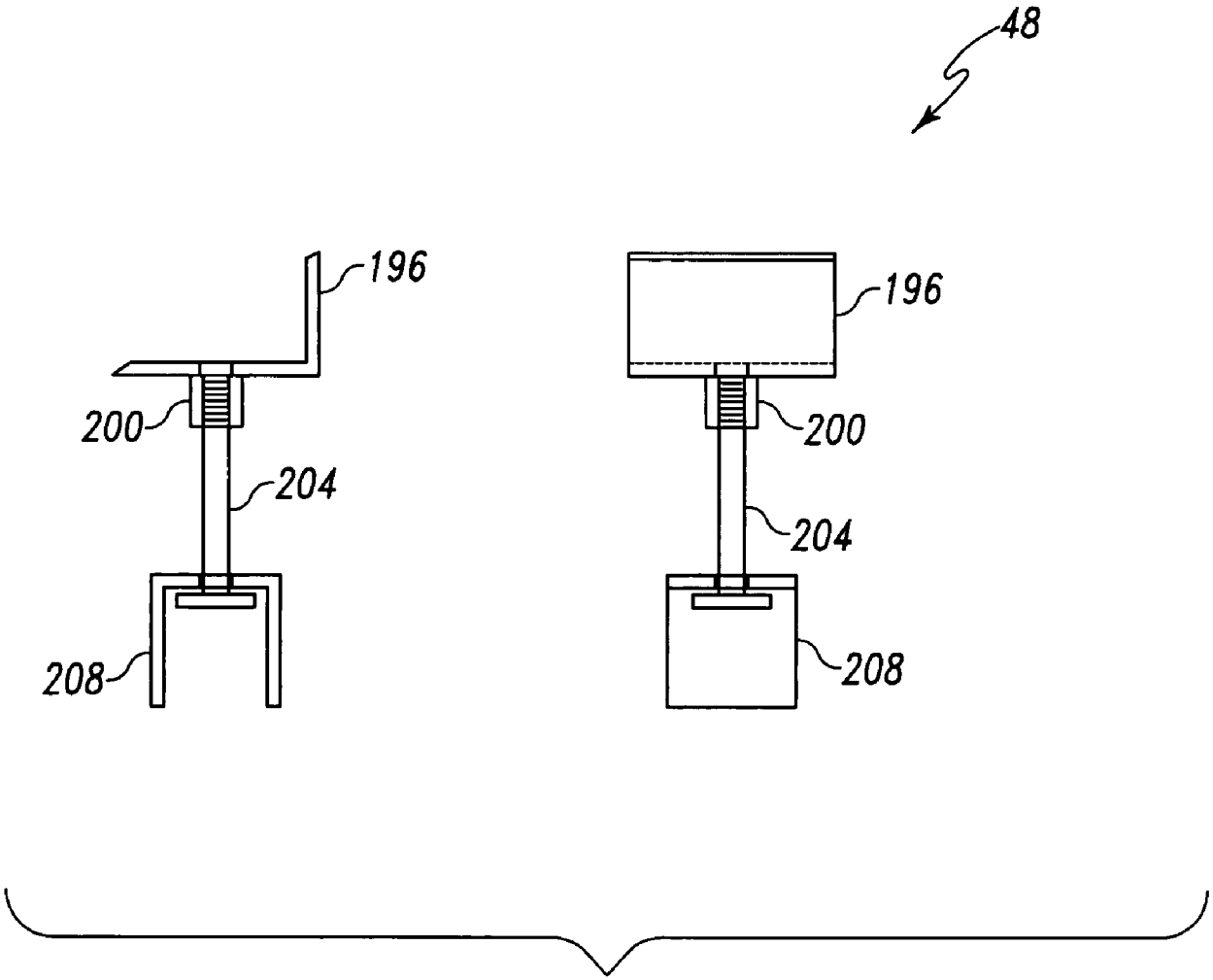
FIG. 17 shows a hot zone shell hanger assembly—two views.
Figure 18:
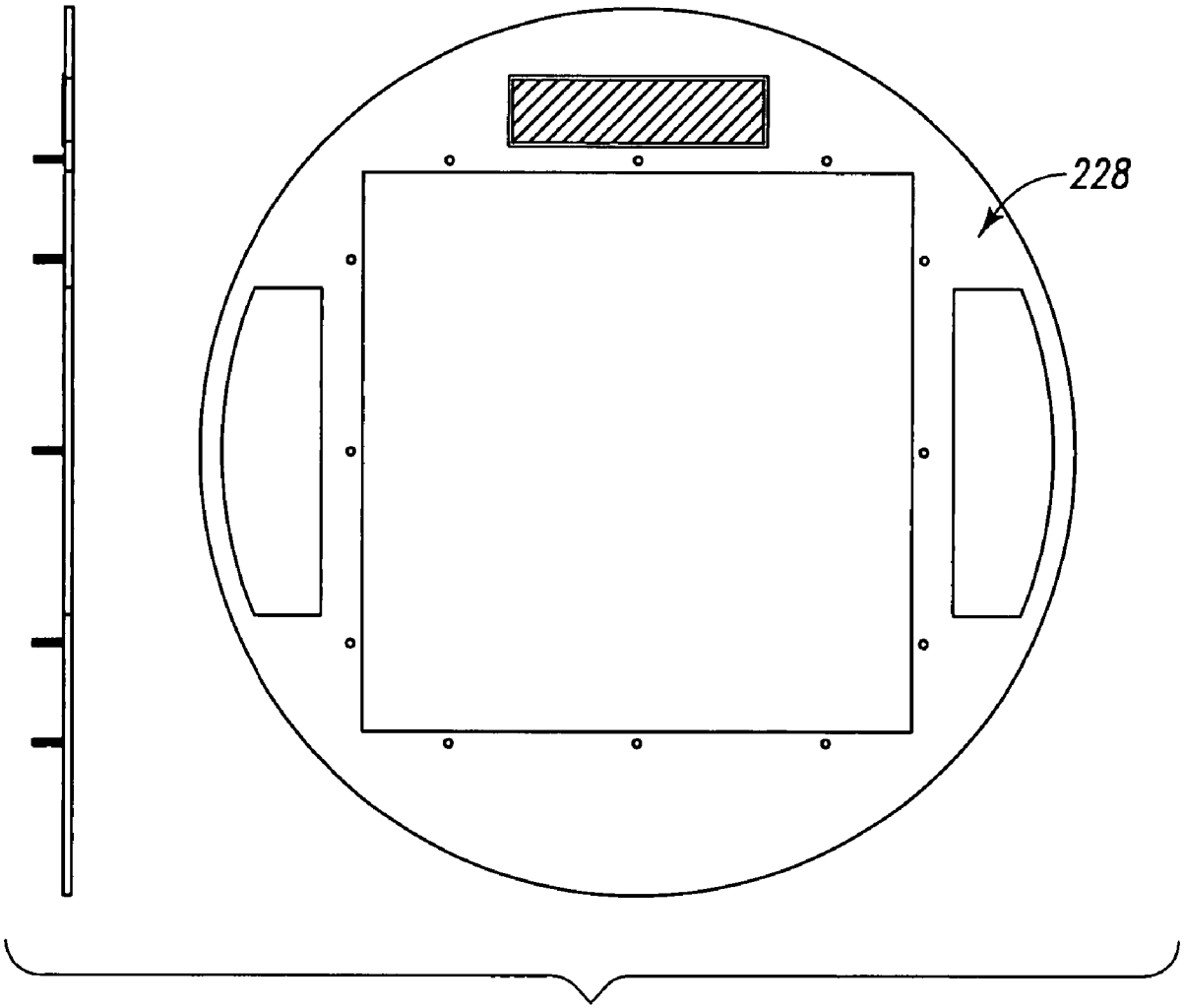
FIG. 18 shows a front gas retainer plate (front door).
Figure 19:
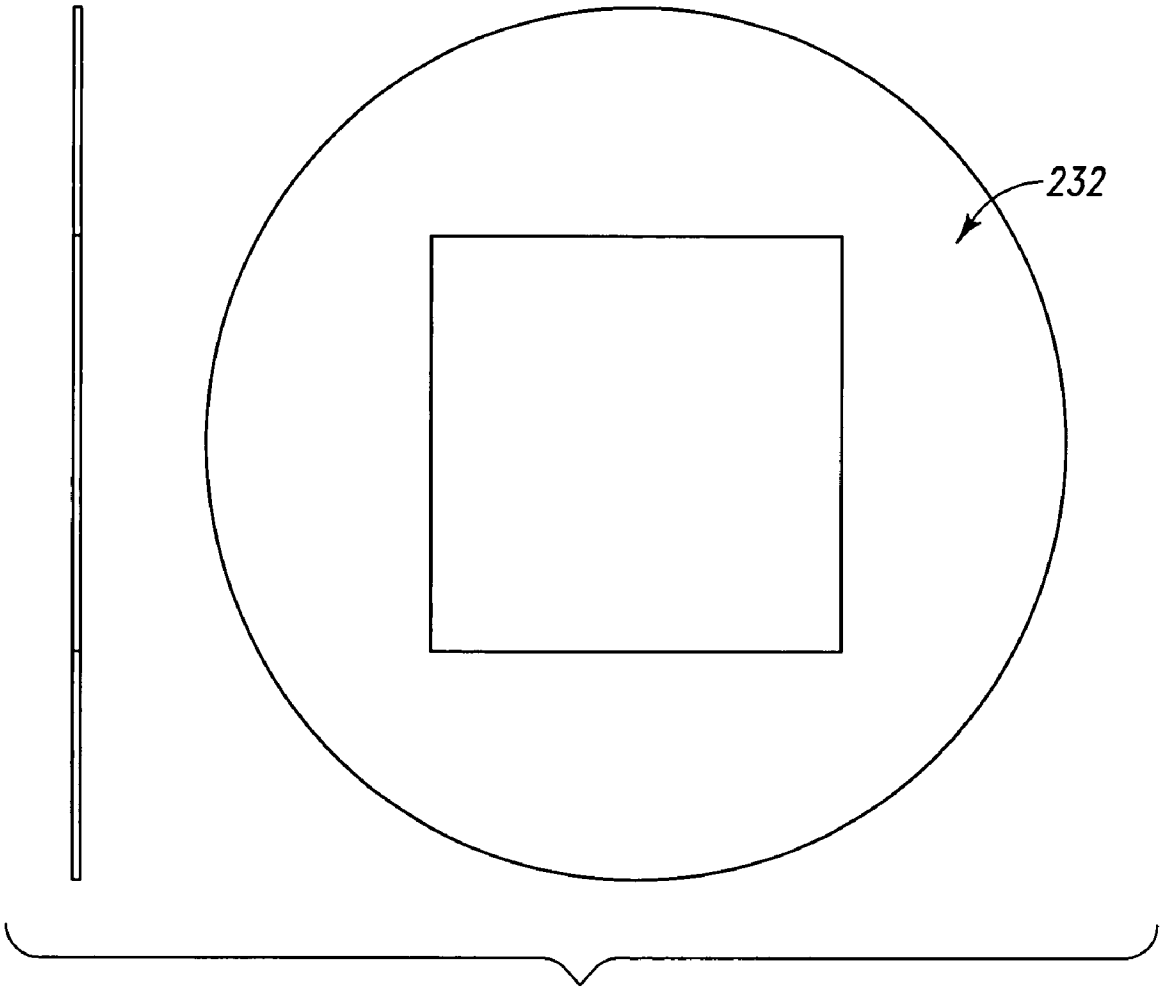
FIG. 19 shows a front gas retainer plate (rear door).
Figure 20:
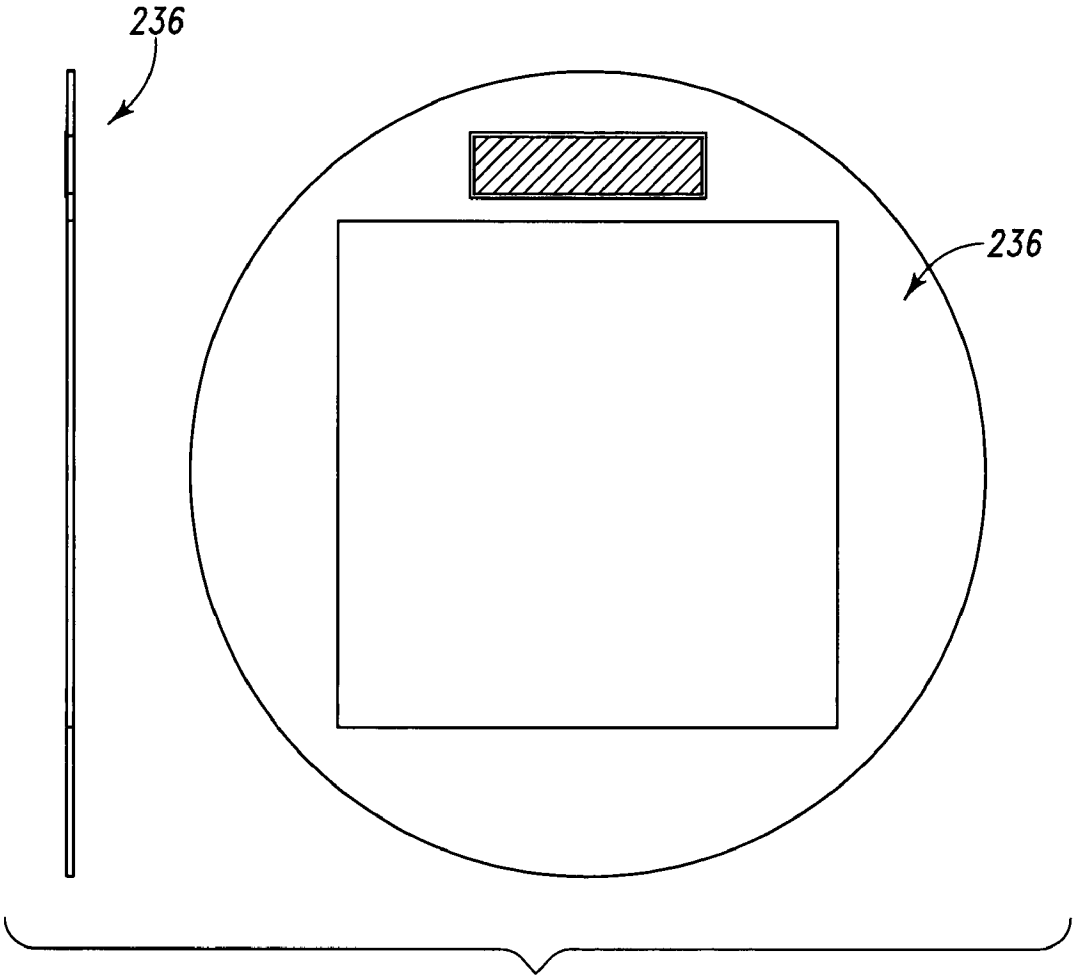
FIG. 20 shows a rear gas retainer plate (rear door).
Figure 21:
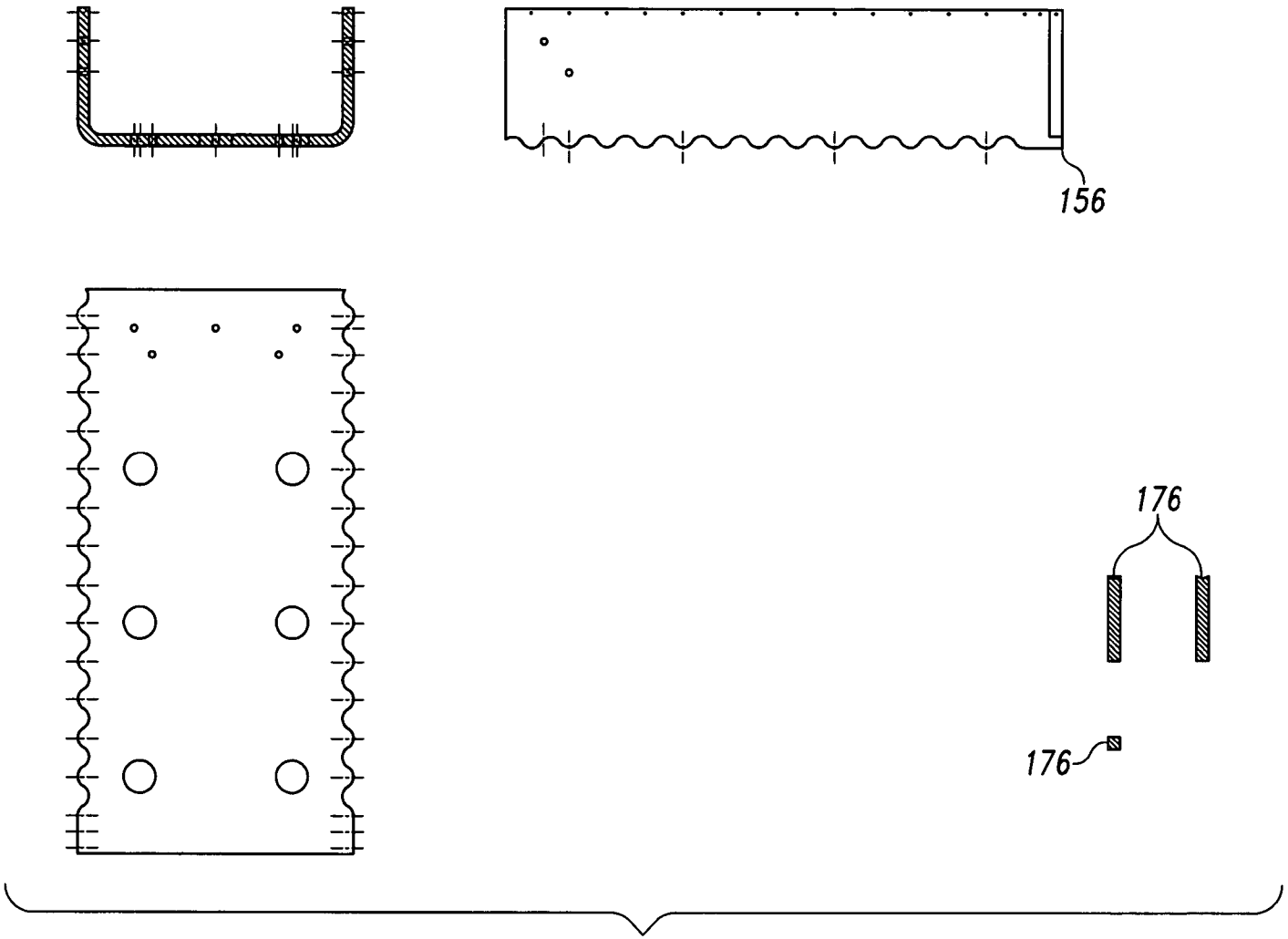
FIG. 21 shows a generally corrugated muffle assembly.
Figure 22:
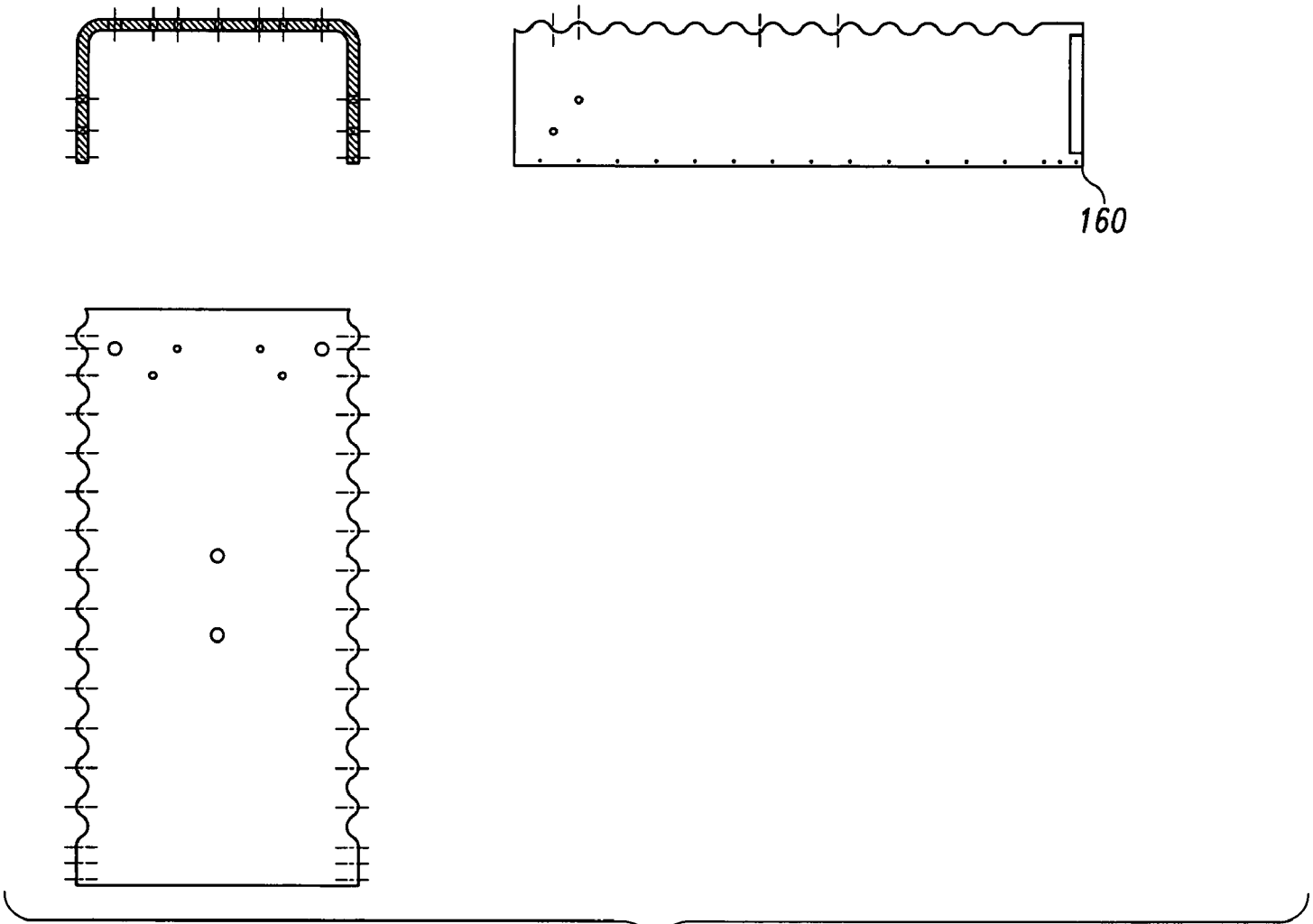
FIG. 22 shows a generally corrugated muffle assembly.

The hot zone shell hanger assembly 48 is seen in detail in FIG. 17. The illustrated hot zone shell hanger assembly 48 includes an angle iron plate 196 and full coupling 200, both of which may be constructed with a suitable steel or other suitable material. A bolt 204 and a u-channel 208 are shown operatively connected to the angle iron plate 196. The bolt 204 and the u-channel 208 may be constructed with a suitable stainless steel or other suitable material. The inner sleeve 49 and the outer sleeve 50 of the muffle are indirectly supported by the hot zone shell hanger assembly 48, as shown on FIG. 15.

Figure 4:
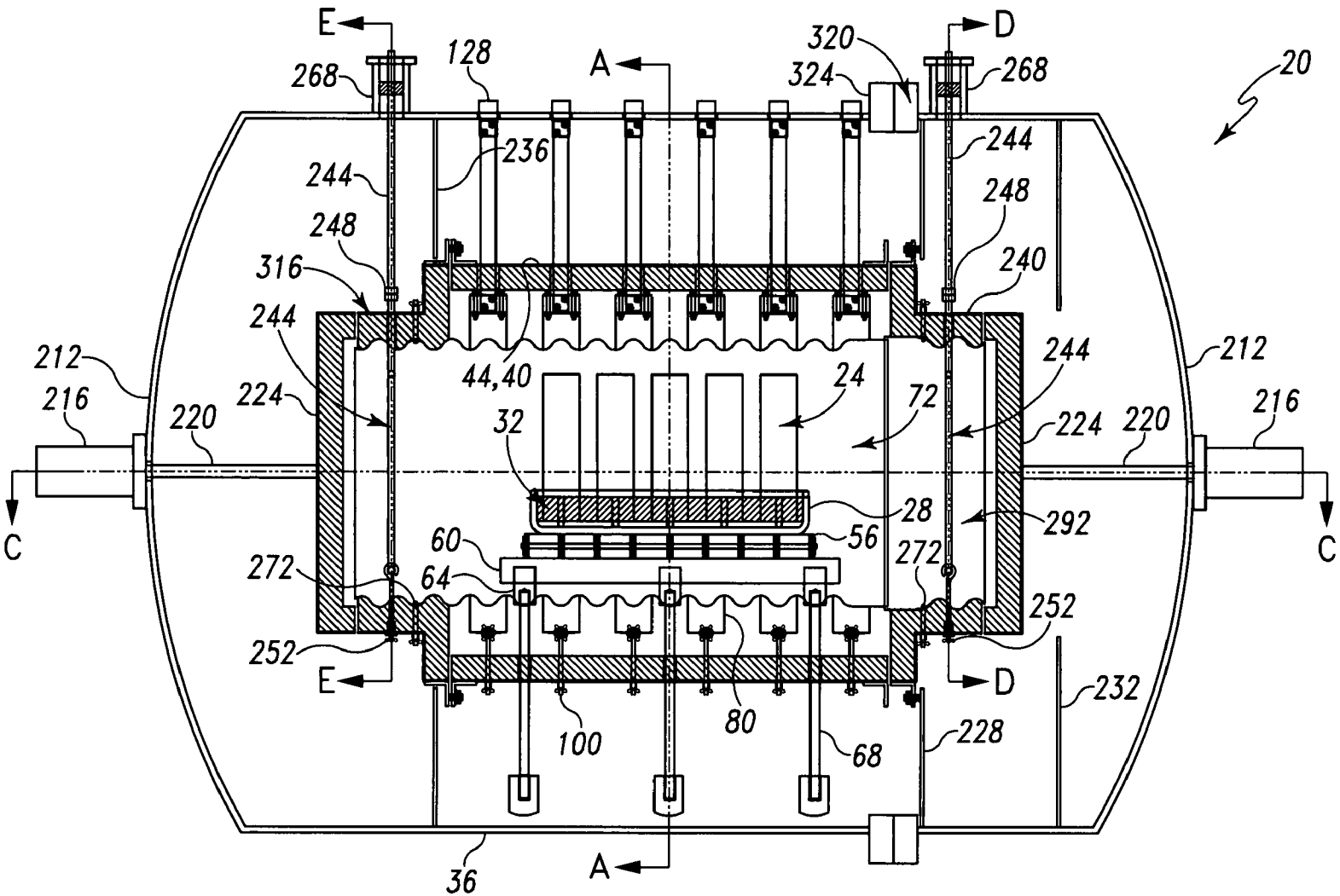
FIG. 4 shows a side view of the vacuum furnace of FIG. 3 along line B-B of FIG. 3.
Figure 5:
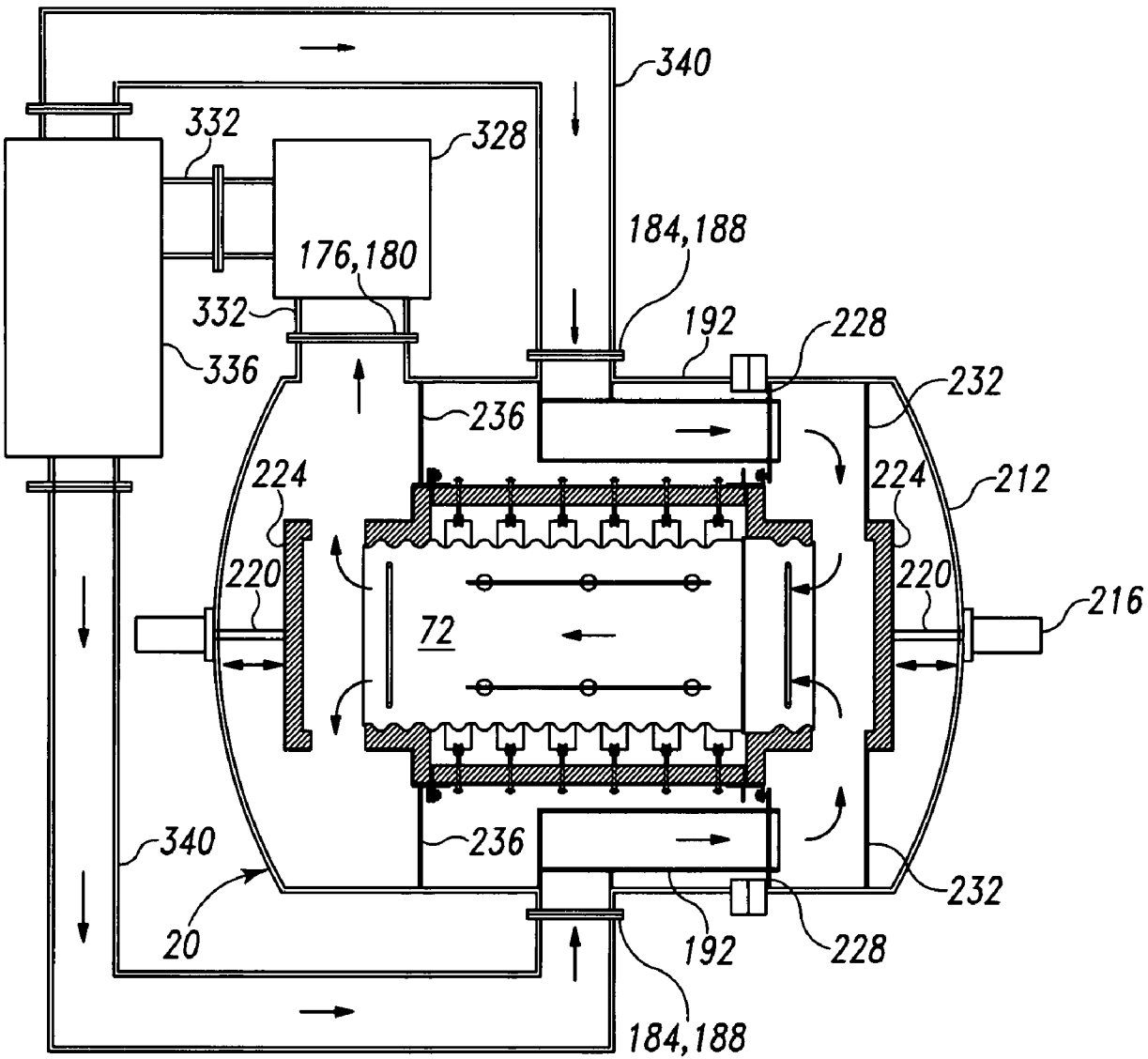
FIG. 5 shows a top plan flow diagram along line C-C of FIG. 4 of the vacuum furnace of FIG. 4 with doors open in a cooling mode.

Referring now primarily to FIGS. 4 and 5, the illustrated furnace 20 includes a flanged and dished head 212 on generally opposing sides of the furnace 20, as shown. Both sides of the illustrated furnace 20 feature a double acting cylinder 216. Each double acting cylinder 216 is provided in the vacuum housing. A piston rod 220 is shown operatively connected to the cylinder 216. A pair of muffle end caps 224, which may be insulated, may be provided on opposing ends of the furnace 20, as shown. The piston rod 220 is shown in an extended position with the muffle end cap 224 in a relatively closed position in FIG. 4. The piston rod 220 is shown in a retracted position with the muffle end cap 224 in a relatively opened position in FIG. 5, thus showing a cooling mode position. The term "mode" is understood to include any suitable number and types of manifestations, forms, or arrangements of being.

A front door front gas retainer plate 228 is shown to the right side for the furnace 20. A front door rear gas retainer plate 232 is shown operatively connected to the muffle end cap 224 to the right side for the furnace 20. A rear door gas retainer plate 236 is shown to the left side of the furnace to facilitate gas flow as shown. A front door 240 is shown in substantial contact with the muffle end cap 224 to the right side for the furnace 20 in FIG. 4. A rear door 316 is shown in substantial contact with the muffle end cap 224 to the left side for the furnace 20 in FIG. 4. A rod heating element 244 and a rod heating element coupling 248 are provided at the front door 240 and a rear door 316. The rod heating element 244 and rod heating element 248 coupling may be constructed with a refractory metal or other suitable material.

Figure 33:
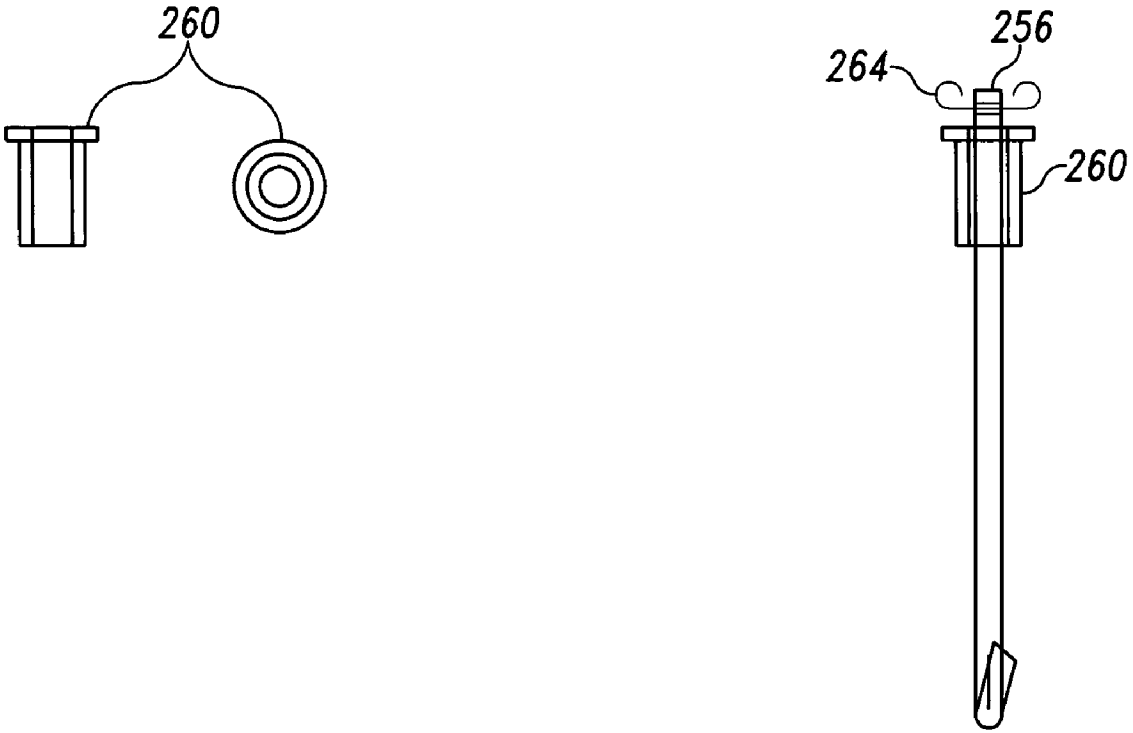
FIG. 33 shows a rod element support assembly.

A rod element support assembly 252, seen also in FIG. 33, is also shown at the front door 240 and the rear door 316. The illustrated rod element support assembly 252 includes an element j-hook retainer rod 256 which may be constructed with a refractory metal or other suitable material. A top hat insulator 260 and wire loop 264 are operatively connected to the element j-hook retainer rod 256. The wire loop 264 may be constructed with a refractory metal or other suitable material. The top hat insulator 260 may be constructed with a high purity alumina or other suitable material.

A rod element power feed port 268 is also provided for the front door 240 and the rear door 316. A muffle anchor assembly 272 is also positioned proximate the front door 240 and the rear door 316. The illustrated muffle anchor assembly 272 includes a muffle anchor rod 276 which may be constructed with a refractory metal or other suitable material and a schedule 40 pipe section 280 which may be constructed with a stainless steel or other suitable material. The illustrated muffle anchor assembly 272 also includes a washer 284 and a wire loop 288 which may be constructed with a refractory metal or other suitable material.

Figure 26:
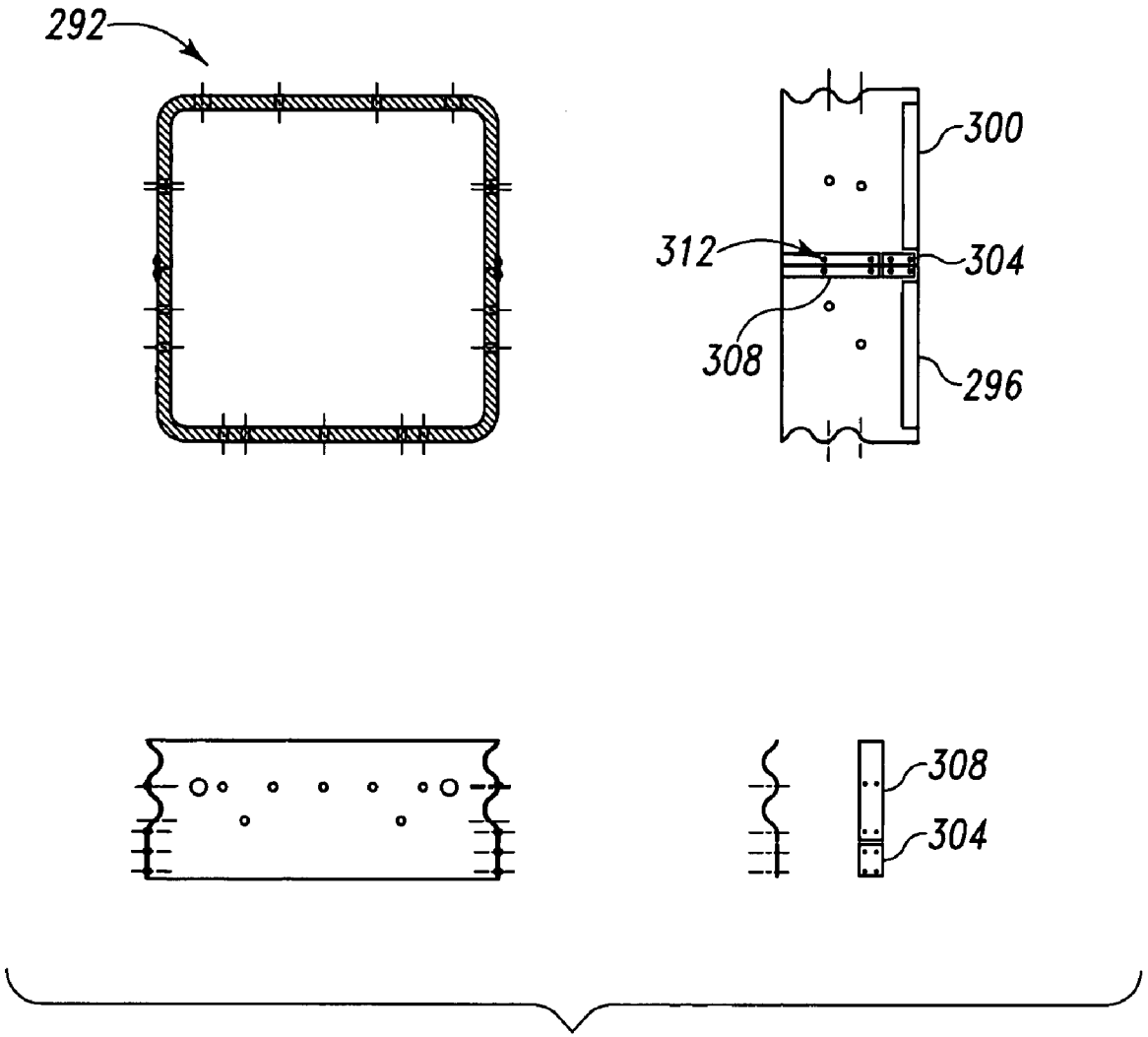
FIG. 26 shows an outer generally corrugated door muffle assembly.
Figure 27:
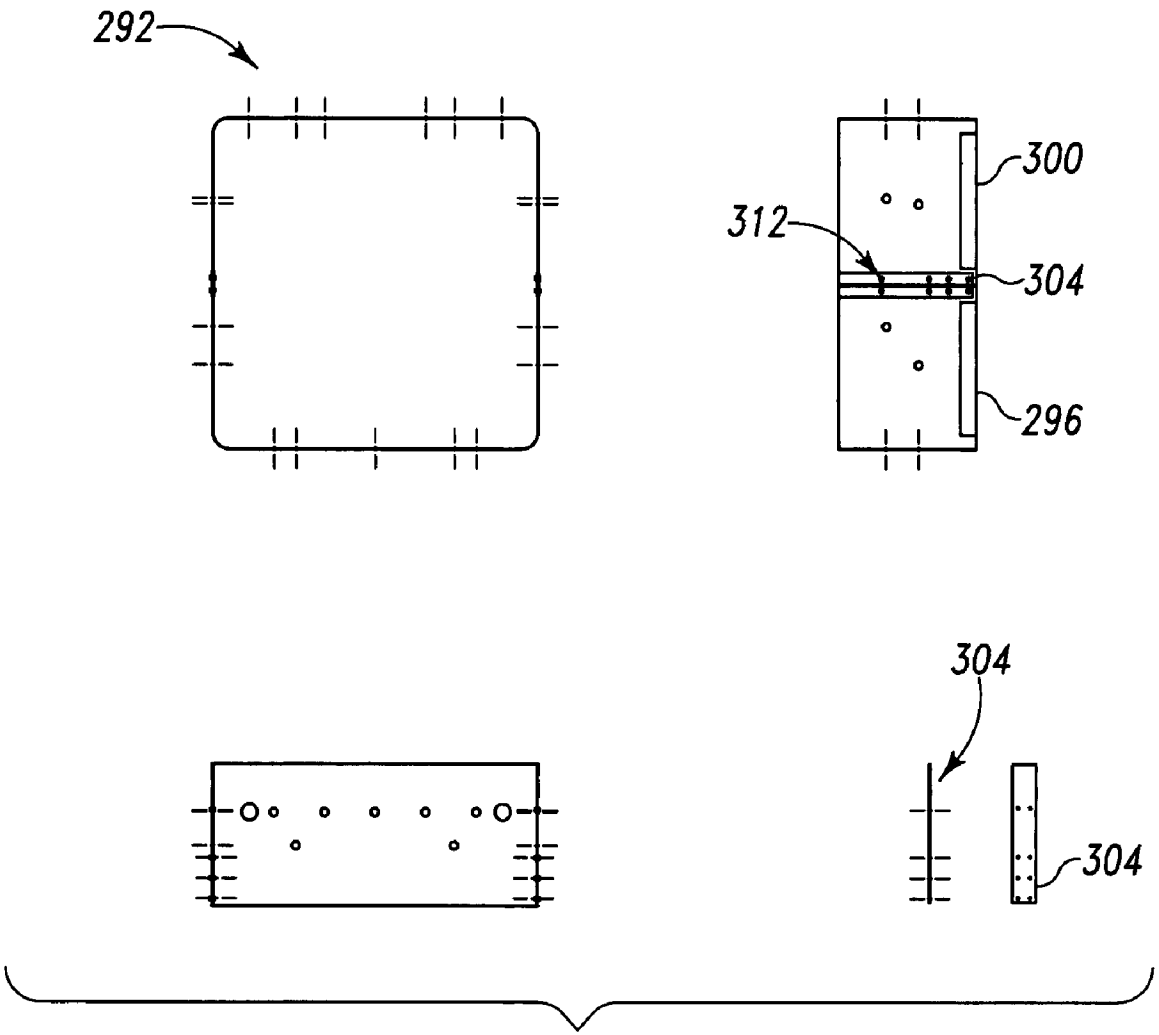
FIG. 27 shows a generally straight door muffle assembly.

The illustrated furnace 20 also features a front door muffle assembly 292, seen also in FIGS. 26 and 27. The illustrated front door muffle assembly 292 features a corrugated muffle bottom section 296 operatively connected to a corrugated muffle top section 300. A suitable muffle joiner strip straight 304 and/or muffle joiner strip corrugated 308 may be provided to facilitate joining. A suitable type and number of rivets 312 may be provided as desired. The components of the illustrated front door muffle assembly 292 may be constructed with a refractory metal or other suitable material. The illustrated furnace 20 also features a front door flange 320 and a vacuum chamber flange 324, both of which may be constructed with steel or other suitable material.

Referring now primarily to FIG. 5, the furnace 20 is shown in a cooling mode. The term "cooling mode" is understood to include a particular functioning arrangement or condition that facilitates cooling of the load compared to other modes, such as for example a heating mode. The illustrated invention includes a high temperature fan and motor 328. The high temperature fan and motor 328 are preferably adapted to accommodate extreme temperatures. A hot gas piping 332 is provided in fluid communication with a heat exchanger 336. Any suitable heat exchanger 336 may be employed, though a water cooled shell and tube model may be considered. A cold gas return piping 340 is positioned as shown downstream of the heat exchanger 336. As indicated by the arrows, a suitable fluid moves though the muffle 72, and thus the load in the muffle, to cool the load. It should be noted that the fluid moves in a substantially unidirectional flow within the muffle. The fluid flows in a substantially unidirectional flow through the muffle.

Figure 6:
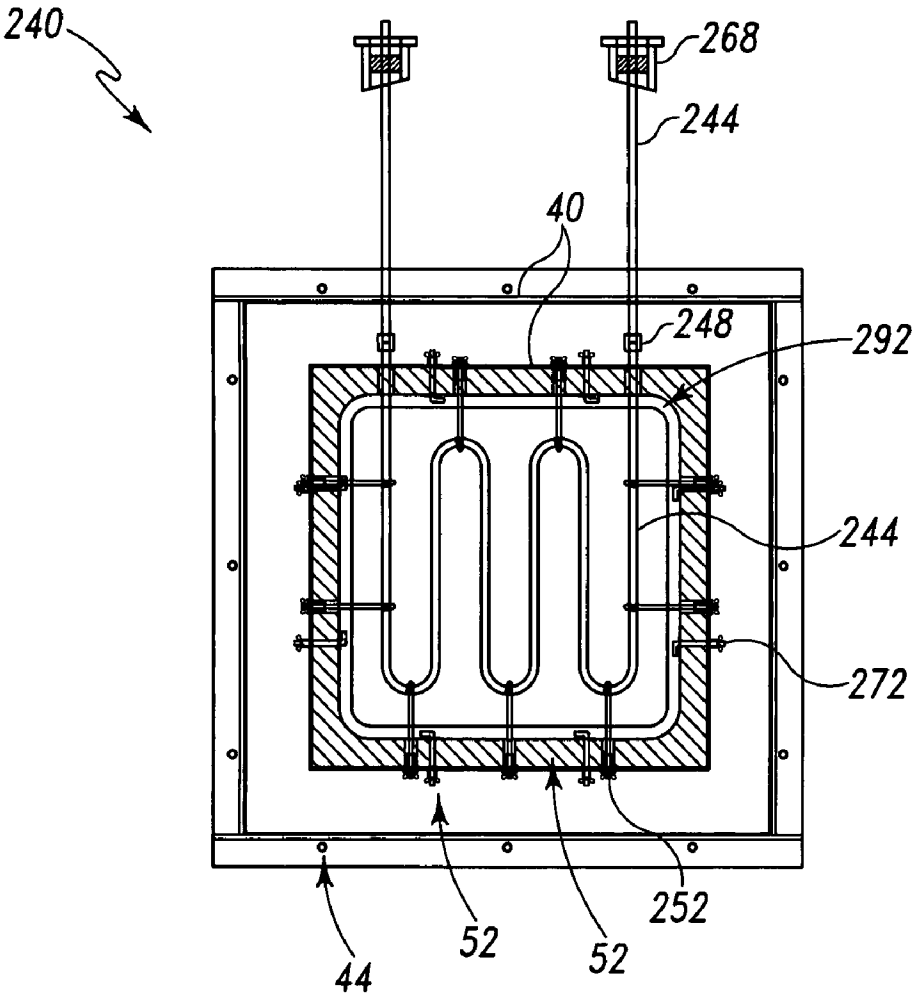
FIG. 6 shows a section view of a hot zone front door.

Referring now primarily to FIG. 6, the illustrated front door 240 includes the rod heating element 244 and a rod heating element coupling 248. It should be noted that the rod heating element 244 is a means for heating the fluid. Other means for heating the fluid may be employed and positioned as desired. The illustrated rod heating element 244 is located substantially within at least one end of the muffle.

Figure 7:
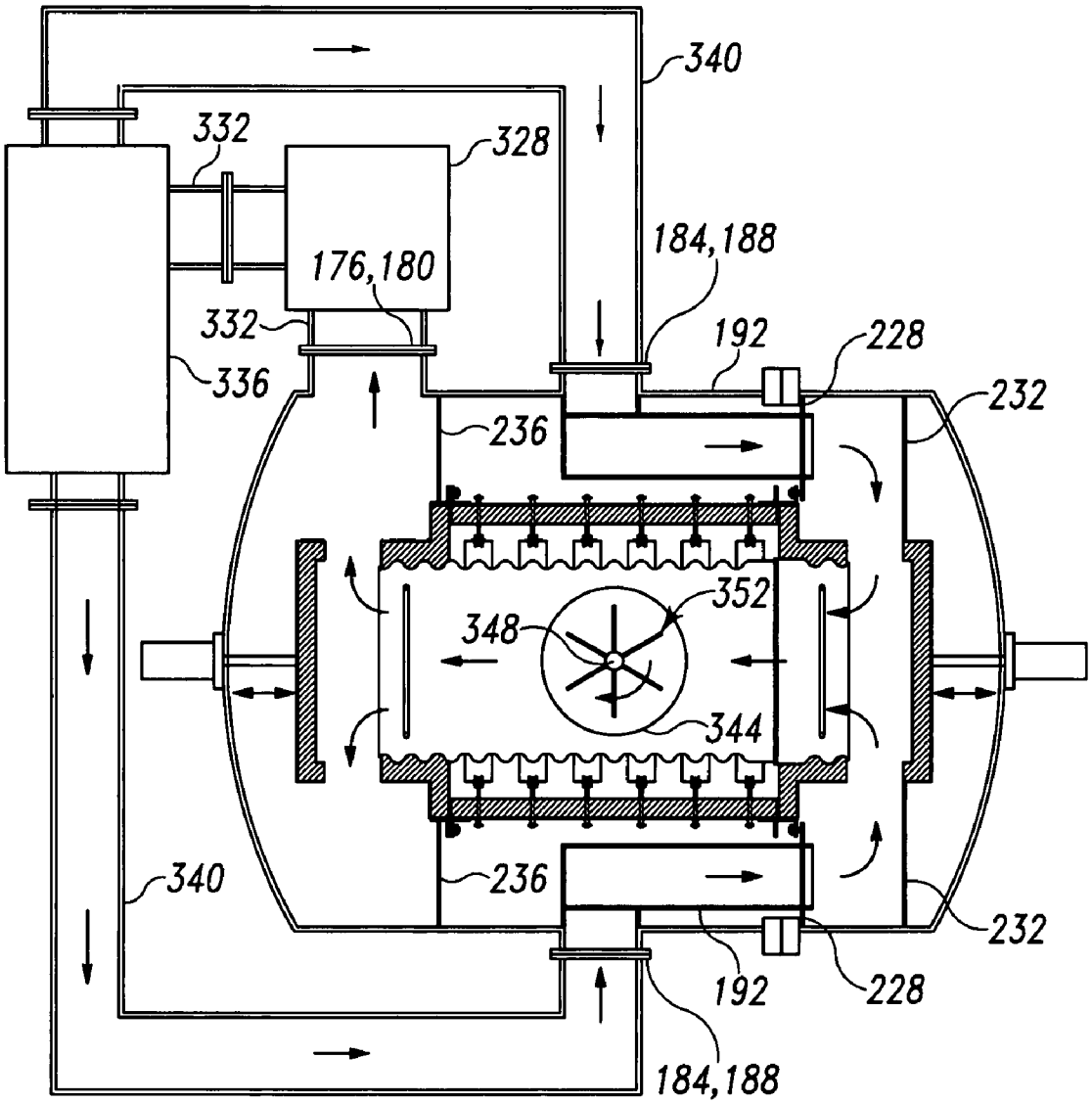
FIG. 7 shows a top plan view of a turntable in a hot zone.

Referring now primarily to FIG. 7, an alternate embodiment is shown. A number or components of the invention shown in FIG. 5 also appear in FIG. 7. FIG. 7 also features a turntable 344. Without wishing to be bound by theory, it is believed that the turntable 344 may reduce the potential for positional heating and/or cooling by rotating the load. The rotation of the turntable 344 better allows the load to be more evenly exposed and/or positioned for heating and/or cooling. A suitable number of type of turntable supports 348 and a turntable shaft 352 may be employed for support and movement of the turntable 344. The turntable 344, turntable supports 348, and turntable shaft 352 may be constructed with a refractory metal or other suitable material.

Figure 8:
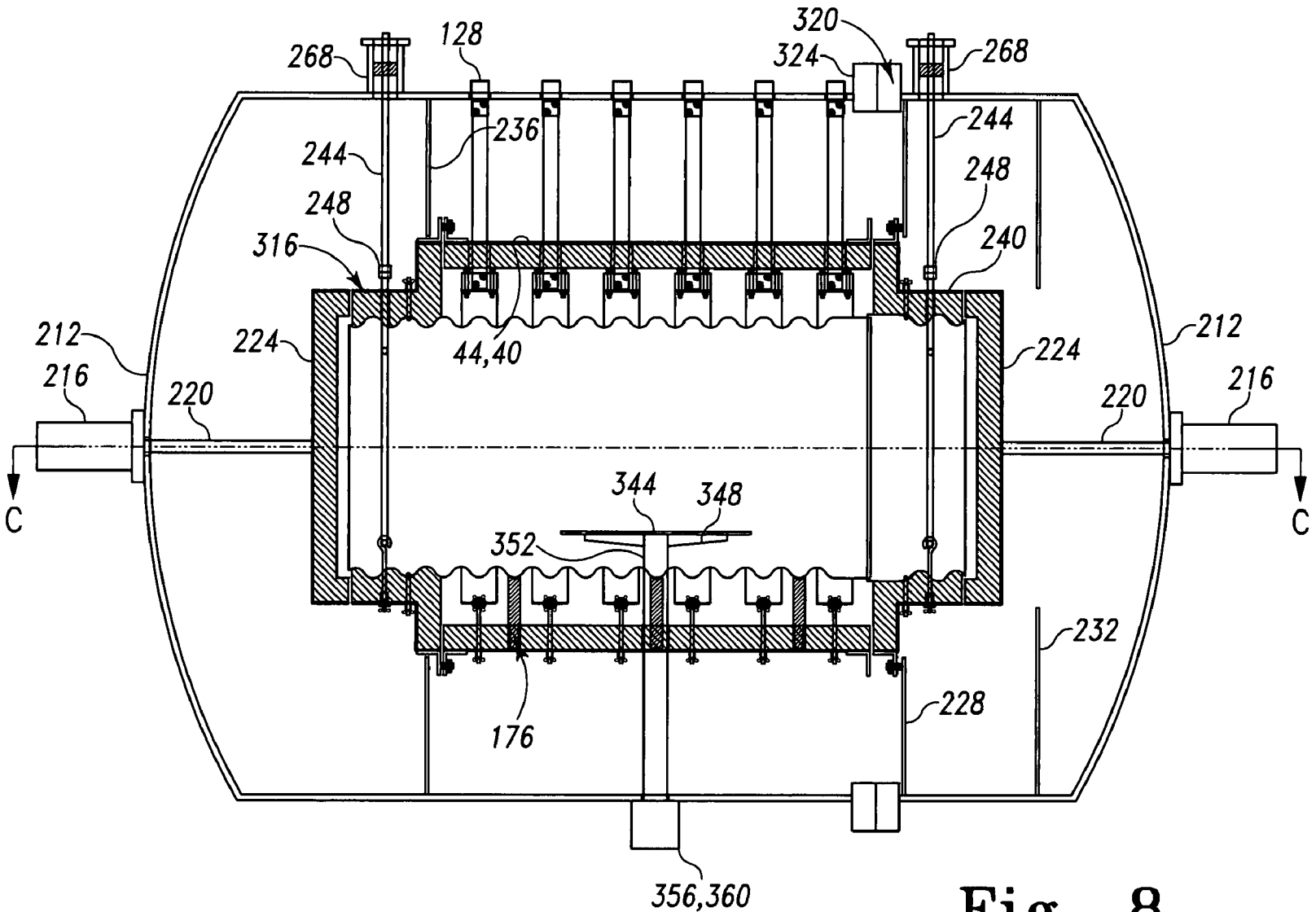
FIG. 8 shows a side view of the turntable of FIG. 7.

Referring now primarily to FIG. 8, another view of the vacuum furnace with the turntable 344, turntable supports 348, and turntable shaft 352 is provided. A number or components of the invention shown in FIG. 6 also appear in FIG. 8. A variable speed vacuum motor 356 and vacuum housing 360 may be positioned as shown or in any other suitable fashion.

Figure 9:
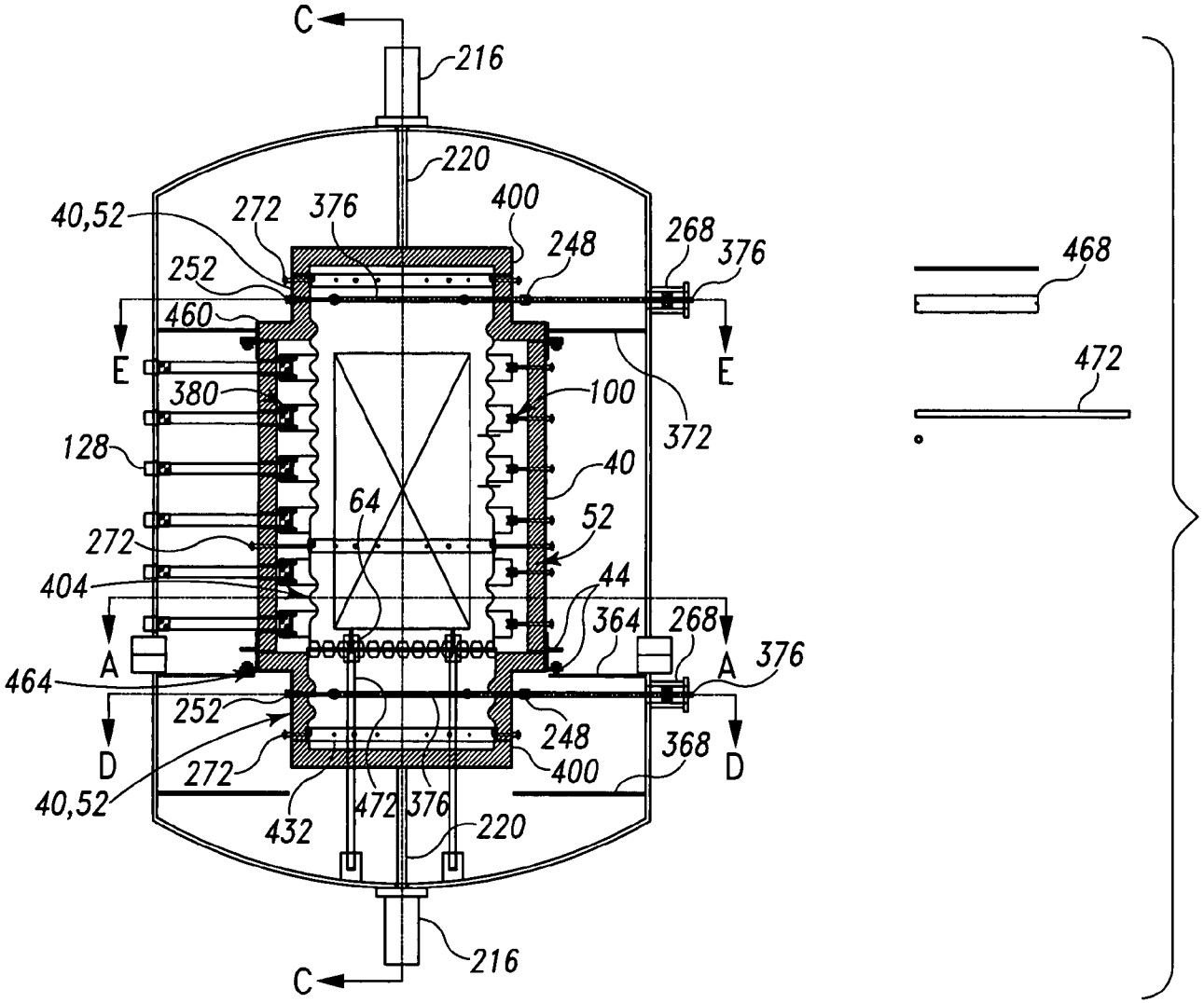
FIG. 9 shows a side view of a generally vertical vacuum furnace
Figure 10:
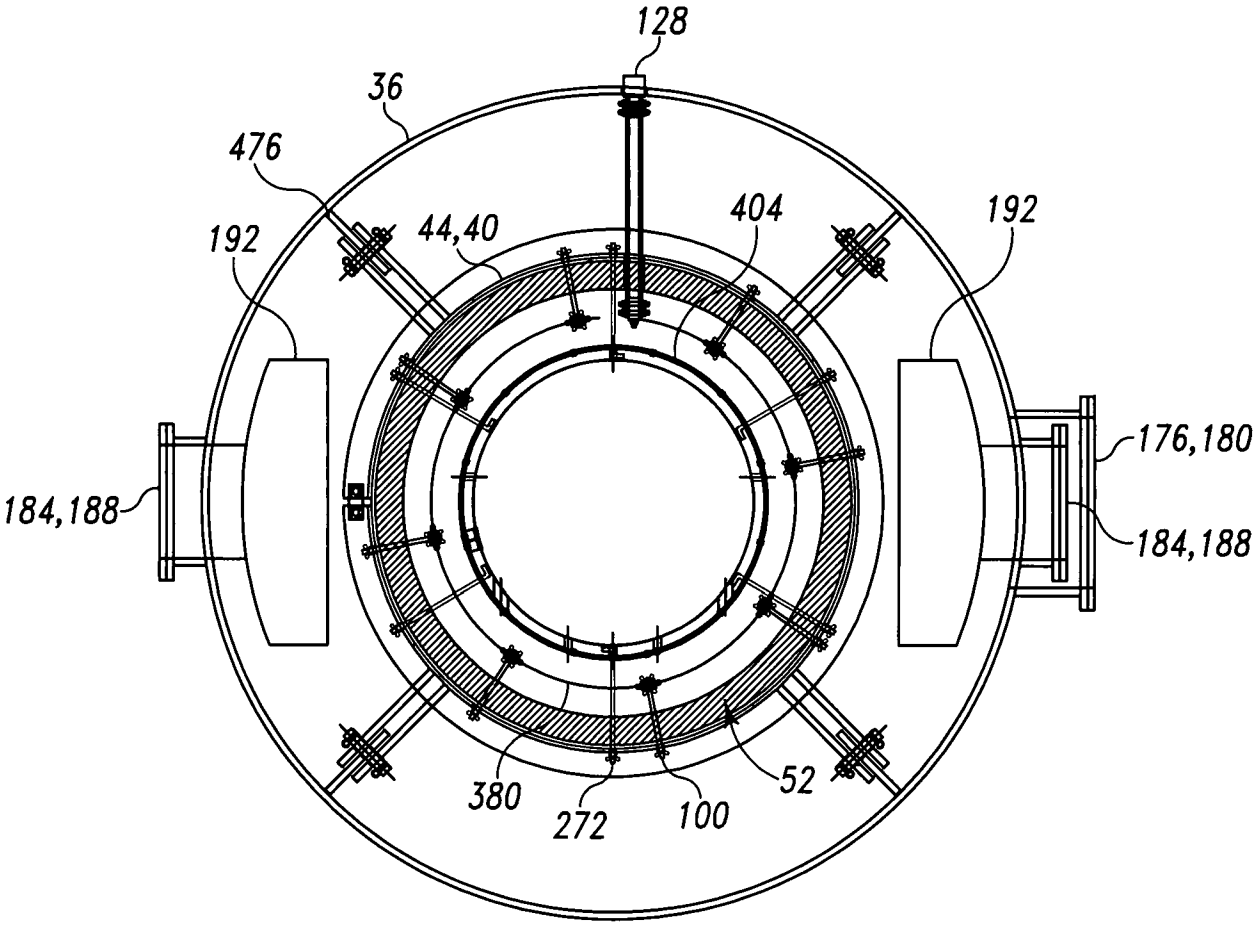
FIG. 10 shows a generally vertical vacuum furnace section view along line A-A of FIG. 9.

Referring now primarily to FIG. 9, an alternate embodiment of the invention is shown. It will be appreciated that the vacuum furnace is shown generally vertically. In FIGS. 9 and 10 aspects of the generally vertical vacuum furnace are also shown. It should be noted that similarly numbered structures and/or components may be employed for the generally horizontal and the generally vertical vacuum furnaces. Unless otherwise indicated or made clear by the context, similarly named and/or numbered structures and/or components function and/or operate analogously for the generally horizontal and the generally vertical vacuum furnaces.

Figure 28:
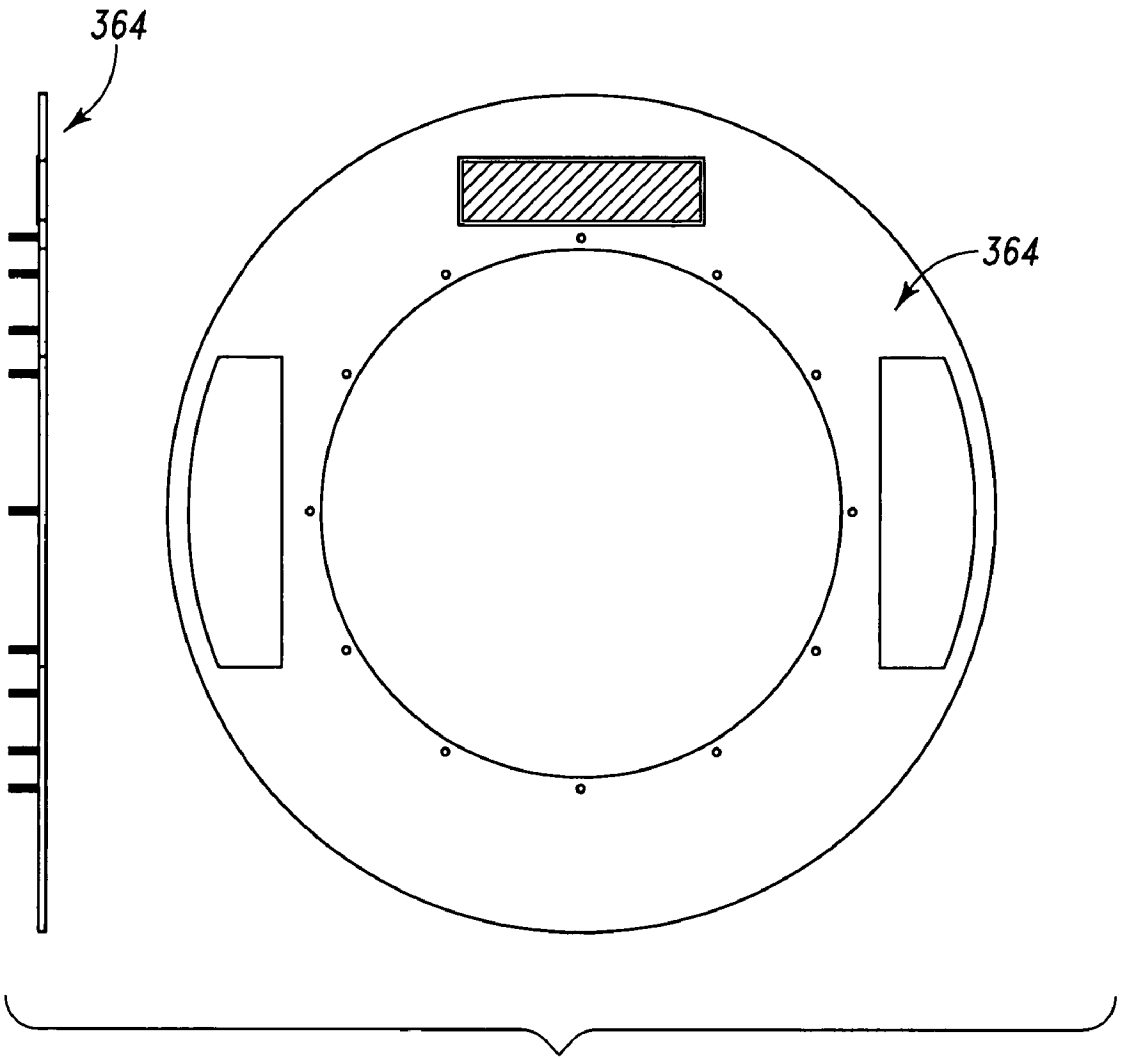
FIG. 28 shows an upper gas retainer plate.
Figure 29:
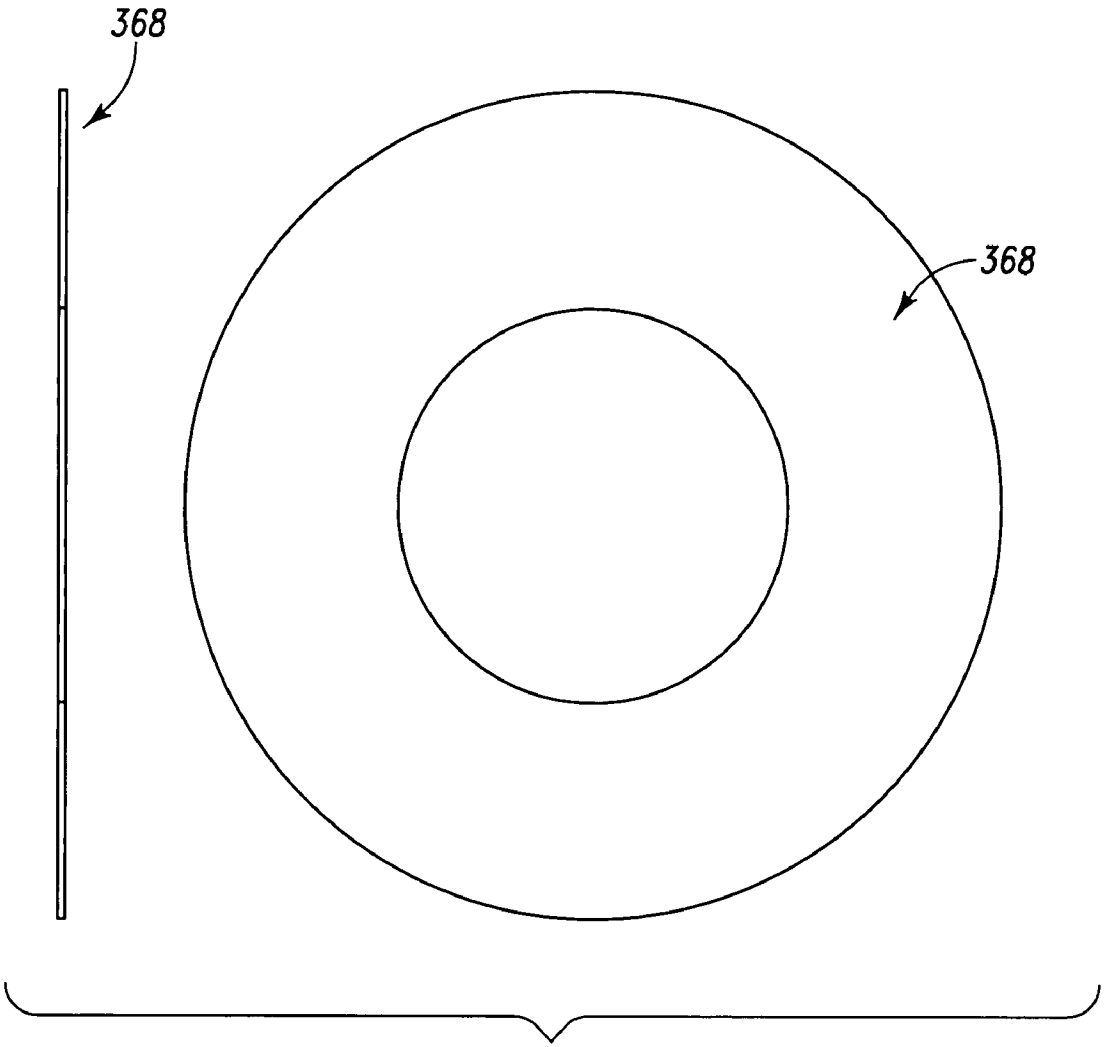
FIG. 29 shows a lower gas retainer plate.
Figure 30:
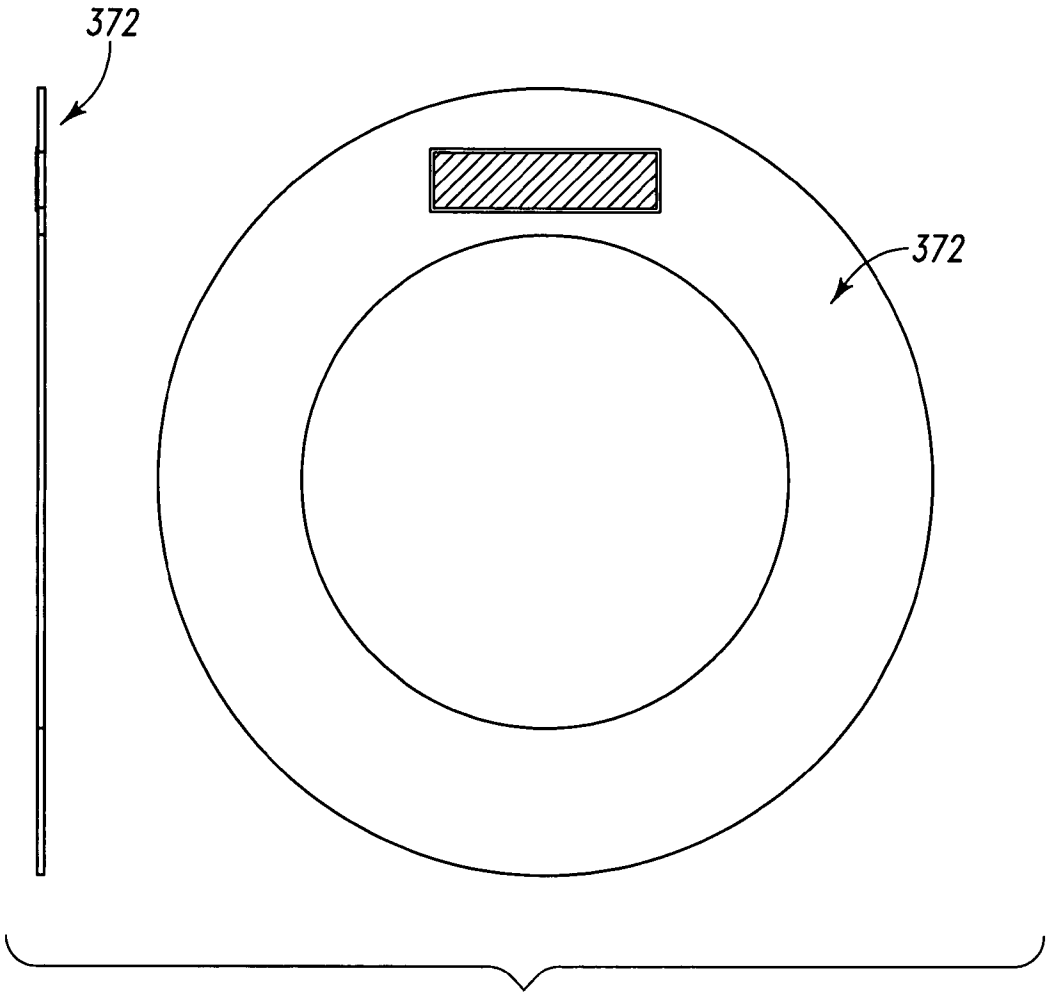
FIG. 30 shows a top gas retainer plate.
Figure 31:
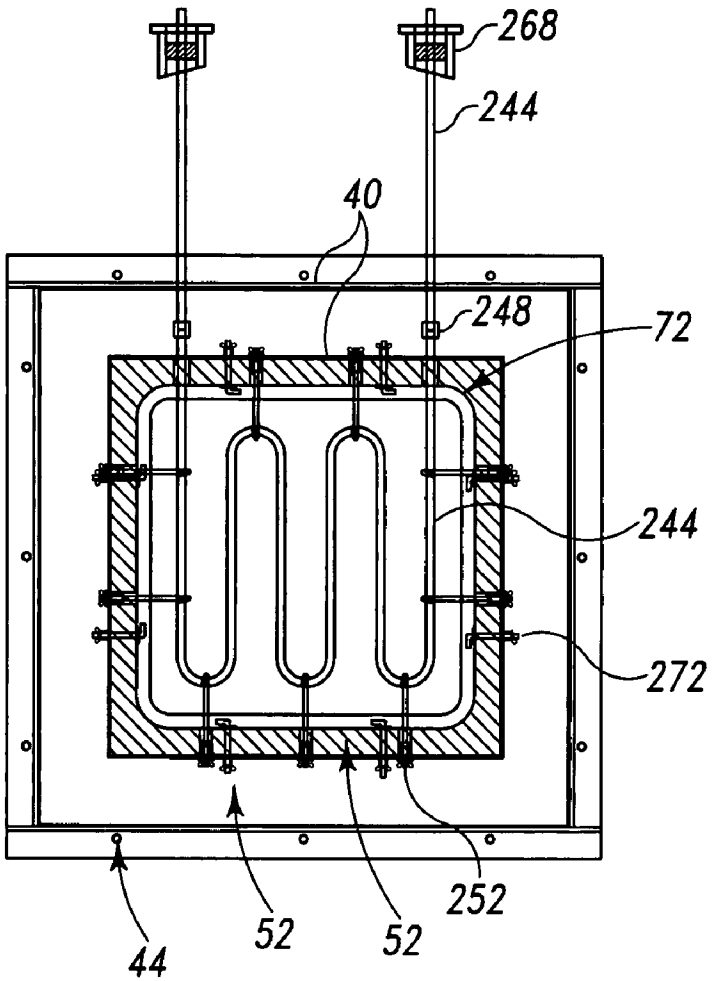
FIG. 31 shows a hot zone rear door section view.
Figure 32:
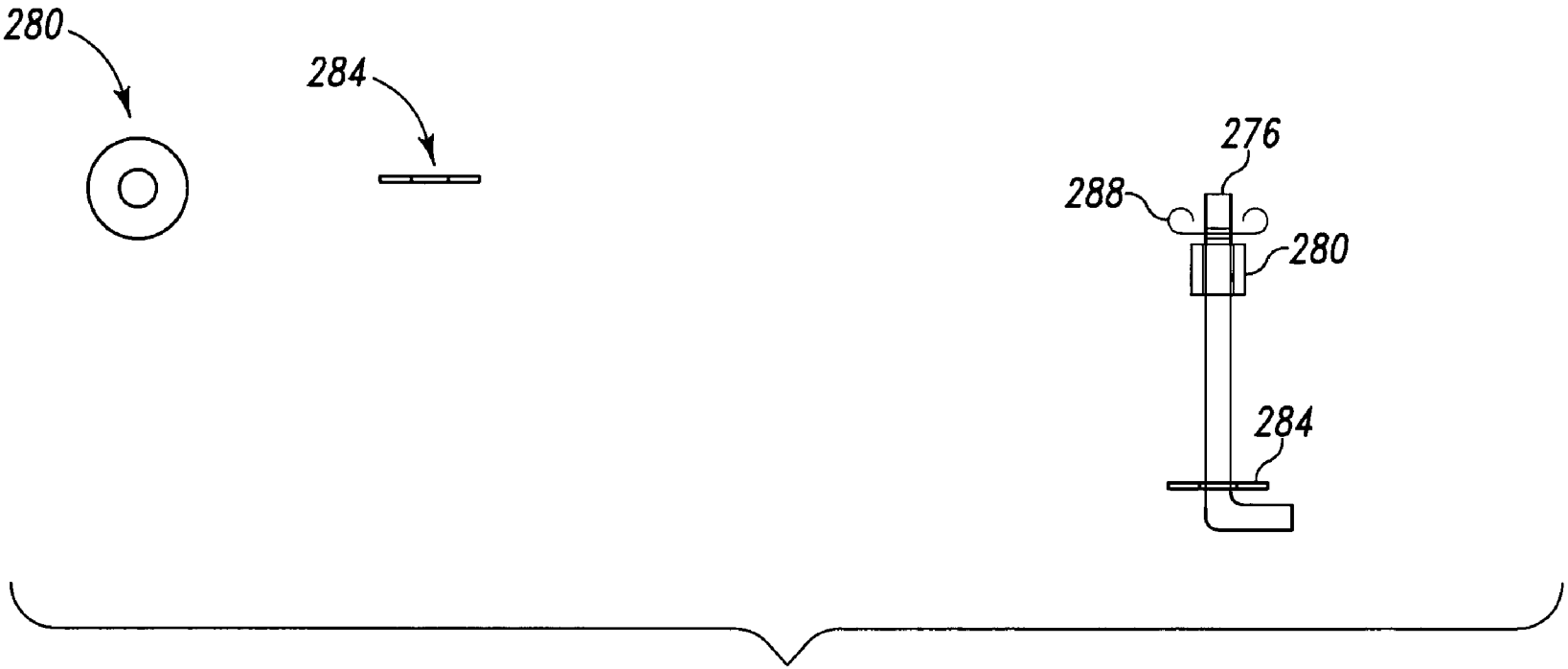
FIG. 32 shows a muffle anchor assembly.

The generally vertical vacuum furnace illustrated includes an upper gas retainer plate 364 (seen also in FIG. 28) and a lower gas retainer plate 368 (seen also in FIG. 29) as shown. A top gas retainer plate 372 (seen also in FIG. 30) may also be provided as shown. The upper gas retainer plate 364, the lower gas retainer plate 368, and the top gas retainer plate 372 may be constructed with steel or other suitable material.

Figure 39:
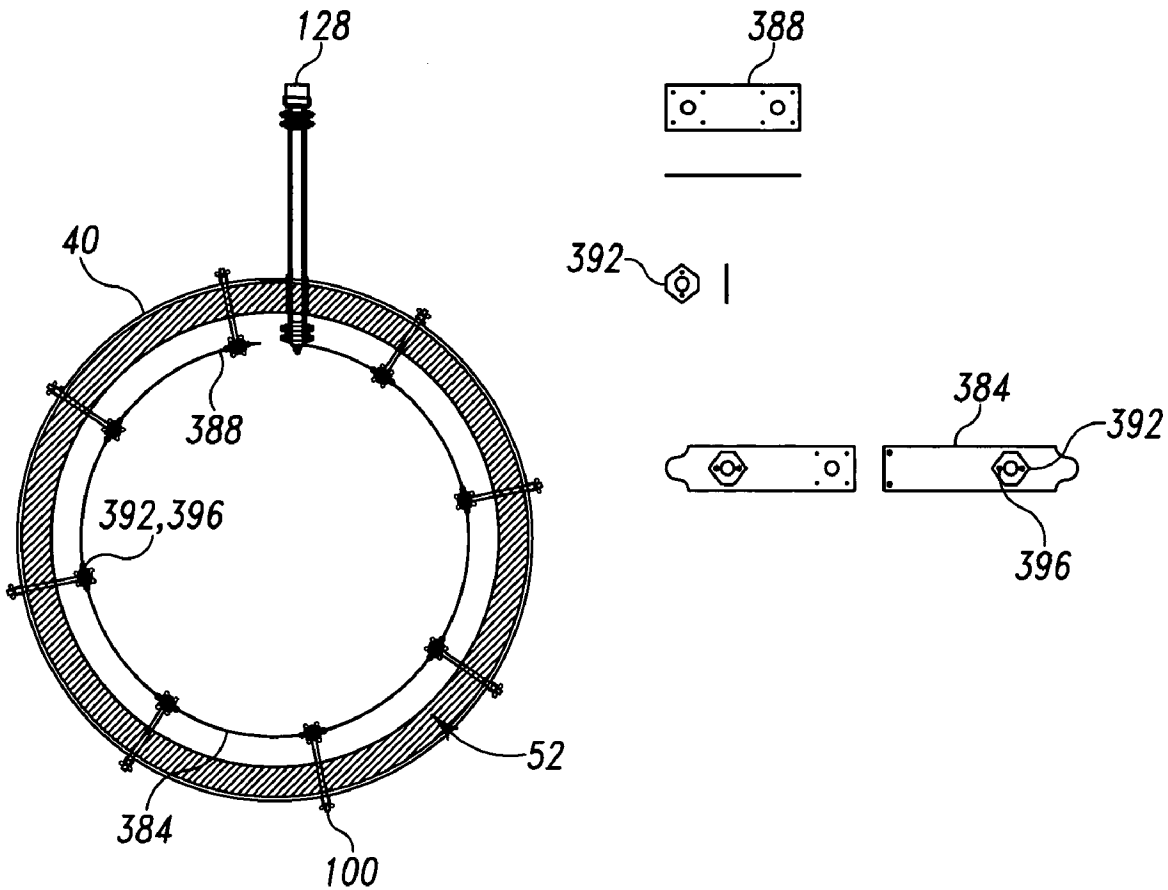
FIG. 39 shows a heating element assembly for vertical vacuum furnace hot zone.

A heating element assembly 380 is shown for the generally vertical vacuum furnace. The illustrated heating element assembly 380 includes a heating element 384 (shown also in FIG. 39). The illustrated heating element 384 is generally circular. The vacuum furnace shown in FIG. 9 includes six heating elements positioned generally equidistant and generally parallel to each other, though any suitable number and placement may be employed. The illustrated heating element 384 may be approximately three inches wide and approximately 0.020 inches thick, though any suitable size parameters may be employed. A heating element jumper plate 388 and a current compensator cap 392 may also be provided. A suitable number and type of rivets 396 may be employed as shown or otherwise. The heating element 384, heating element jumper plate 388, current compensator cap 392, and rivets 396 may be constructed with a refractory metal or other suitable material. A muffle end cap 400 may be provided a shown. The illustrated muffle end cap 400 is generally circular.

Figure 35:
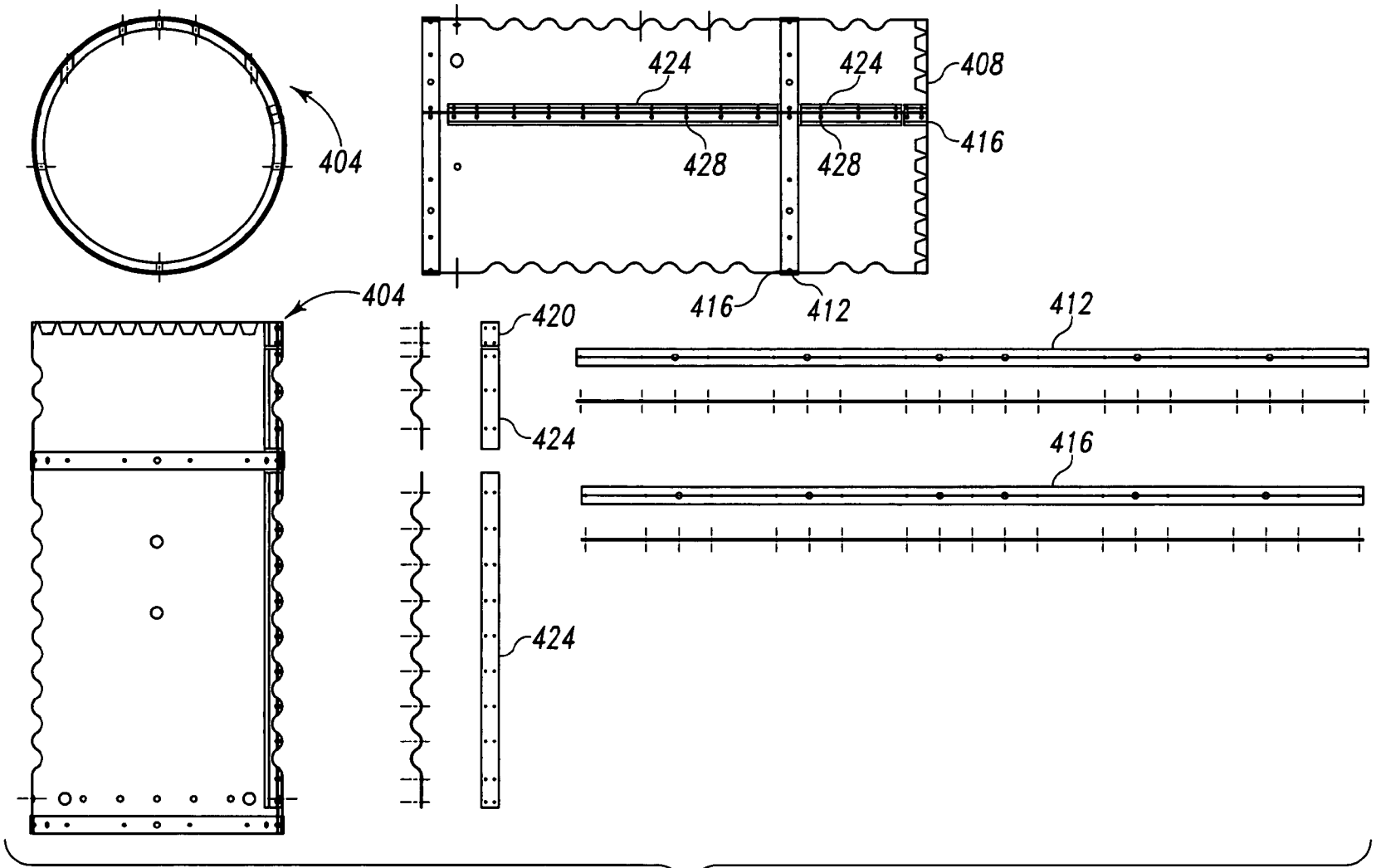
FIG. 35 shows an inner generally vertical muffle assembly according to the invention.

A generally vertical muffle assembly 404 (shown also in FIG. 35) is shown for the generally vertical vacuum furnace. The illustrated vertical muffle assembly 404 may include an approximately ⅞ inch to approximately three inches wide corrugation and may be approximately 0.015 inches thick, though any suitable size parameters may be employed. The vertical muffle assembly 404 includes a corrugated muffle section 408 as shown. An outer muffle reinforcing ring 412 and inner muffle reinforcing ring 416 may be provided as shown. A straight muffle joiner strip 420 and a corrugated muffle joiner strip corrugated 424 may also be included. A suitable number and type of rivets 428 may be employed as shown or otherwise. The components of the generally vertical muffle assembly 404 may be constructed with a refractory metal or other suitable material.

Figure 34:
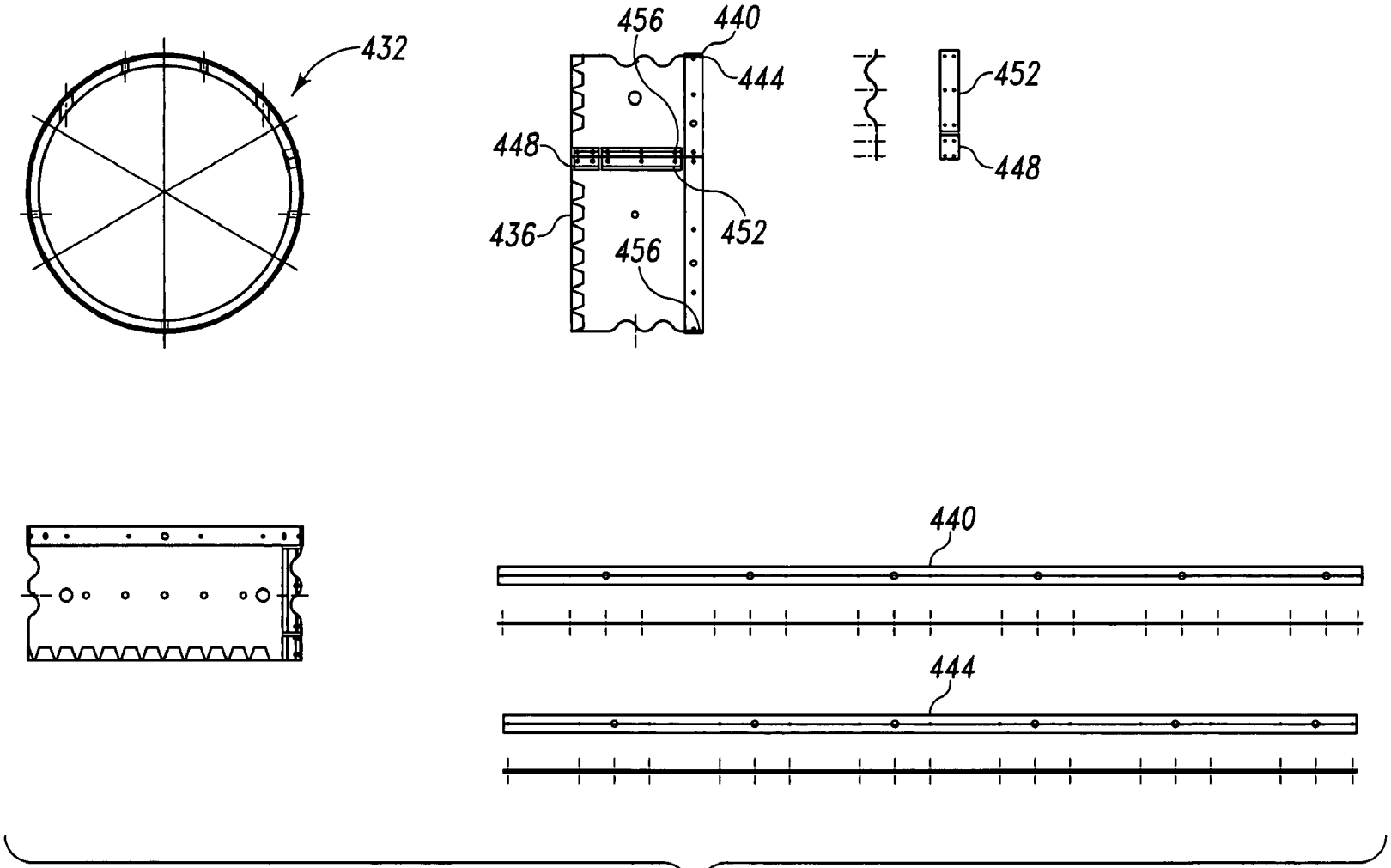
FIG. 34 shows an outer generally corrugated door muffle assembly according to the invention.

The generally vertical vacuum furnace may employ a corrugated door muffle assembly 432 (shown also in FIG. 34). The illustrated corrugated door muffle assembly 432 may include an approximately ⅞ inch to approximately three inches wide corrugation and may be approximately 0.015 inches thick, though any suitable size parameters may be employed. The illustrated corrugated door muffle assembly 432 includes a corrugated muffle section 436 as shown. An outer muffle reinforcing ring 440 and inner muffle reinforcing ring 444 may be provided as shown. A straight muffle joiner strip 448 and a corrugated muffle joiner strip corrugated 452 may also be included. A suitable number and type of rivets 456 may be employed as shown or otherwise. The components of the corrugated door muffle assembly 432 may be constructed with a refractory metal or other suitable material.

Figure 11:
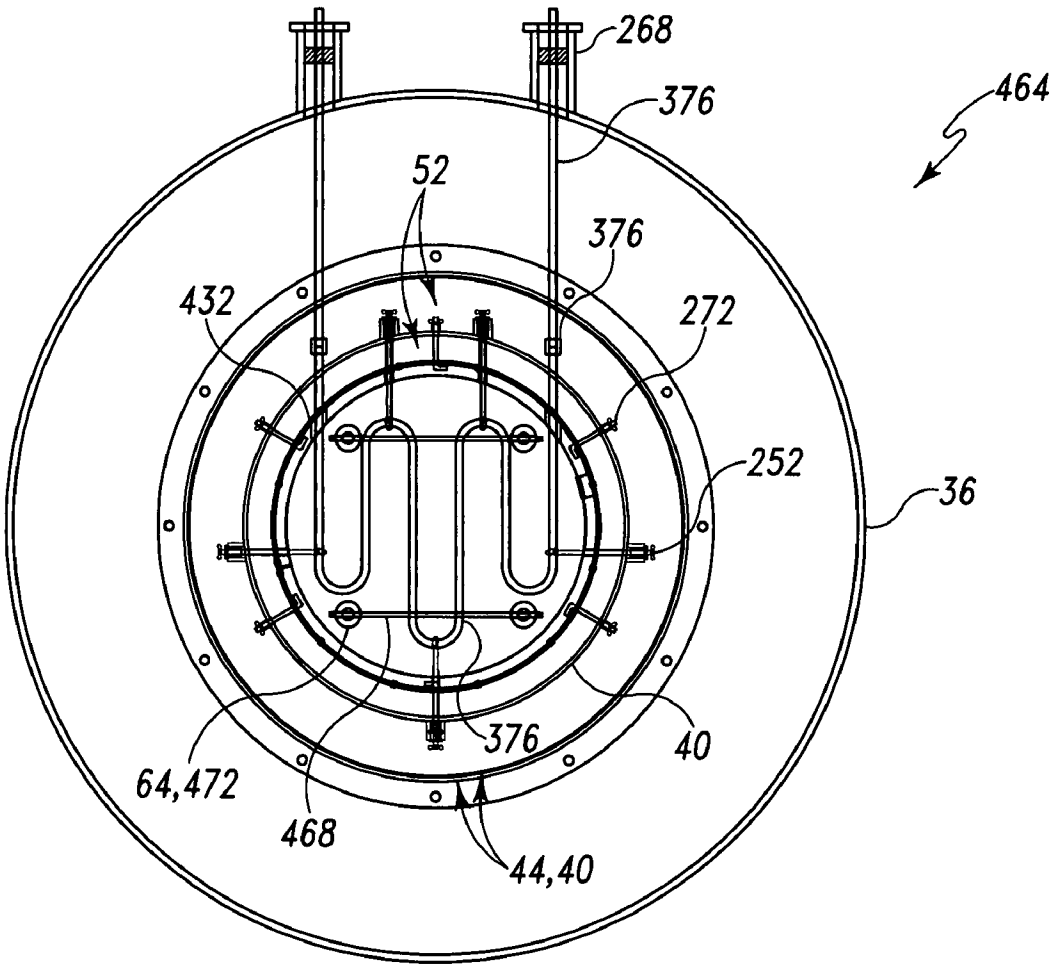
FIG. 11 shows a hot zone bottom door for a generally vertical furnace along line D-D of FIG. 9.
Figure 36:
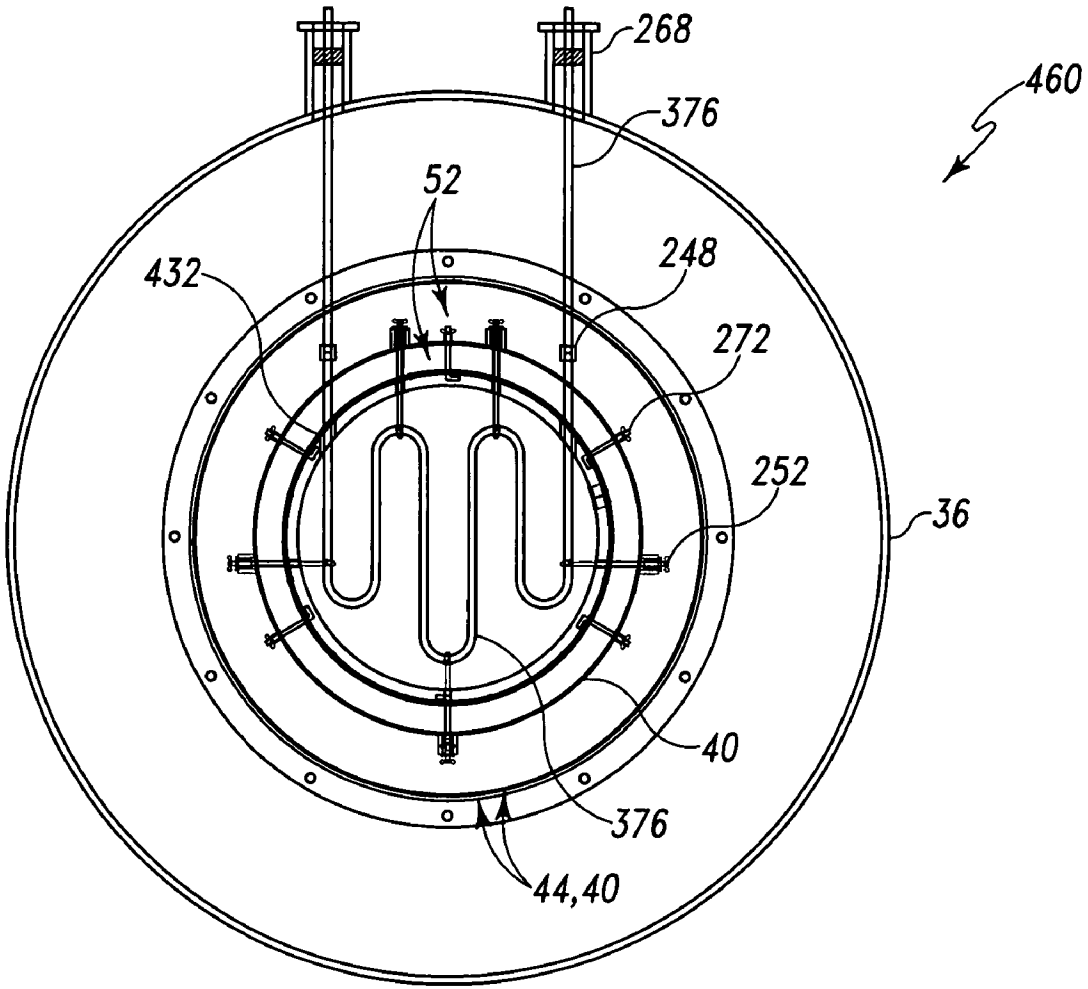
FIG. 36 shows a hot zone top door for a vertical vacuum furnace.

The illustrated generally vertical vacuum furnace includes a hot zone top door 460 (seen in FIG. 36) and a hot zone bottom door 464 (seen in FIG. 11), as shown. The generally vertical vacuum furnace may include a hearth post 472. The illustrated vertical vacuum furnace includes two such hearth posts, though any suitable number and placement may be employed. The generally vertical vacuum furnace may include a hearth bar 468 (seen in FIG. 11). The illustrated vertical vacuum furnace includes two such hearth bars, though any suitable number and placement may be employed. The hearth post(s) and hearth bar(s) may be constructed with a refractory metal or other suitable material.

Referring now primarily to FIG. 10, the generally vertical vacuum furnace may include a vertical hot zone support assembly 476. The illustrated generally vertical vacuum furnace includes four such vertical hot zone support assemblies, though any suitable number and placement may be employed. The vertical hot zone support assembly 476 includes one or more support rod(s) 480 coupled with a suitable number and placement of cotter pin(s) 484. The support rod(s) 480 support one or more chamber support plate(s) 488 and support plate(s) 492. A gusset plate 496 is shown secured to two support plates 492. The components of the vertical hot zone support assembly 476 may be constructed with steel or other suitable material.

Figure 37:
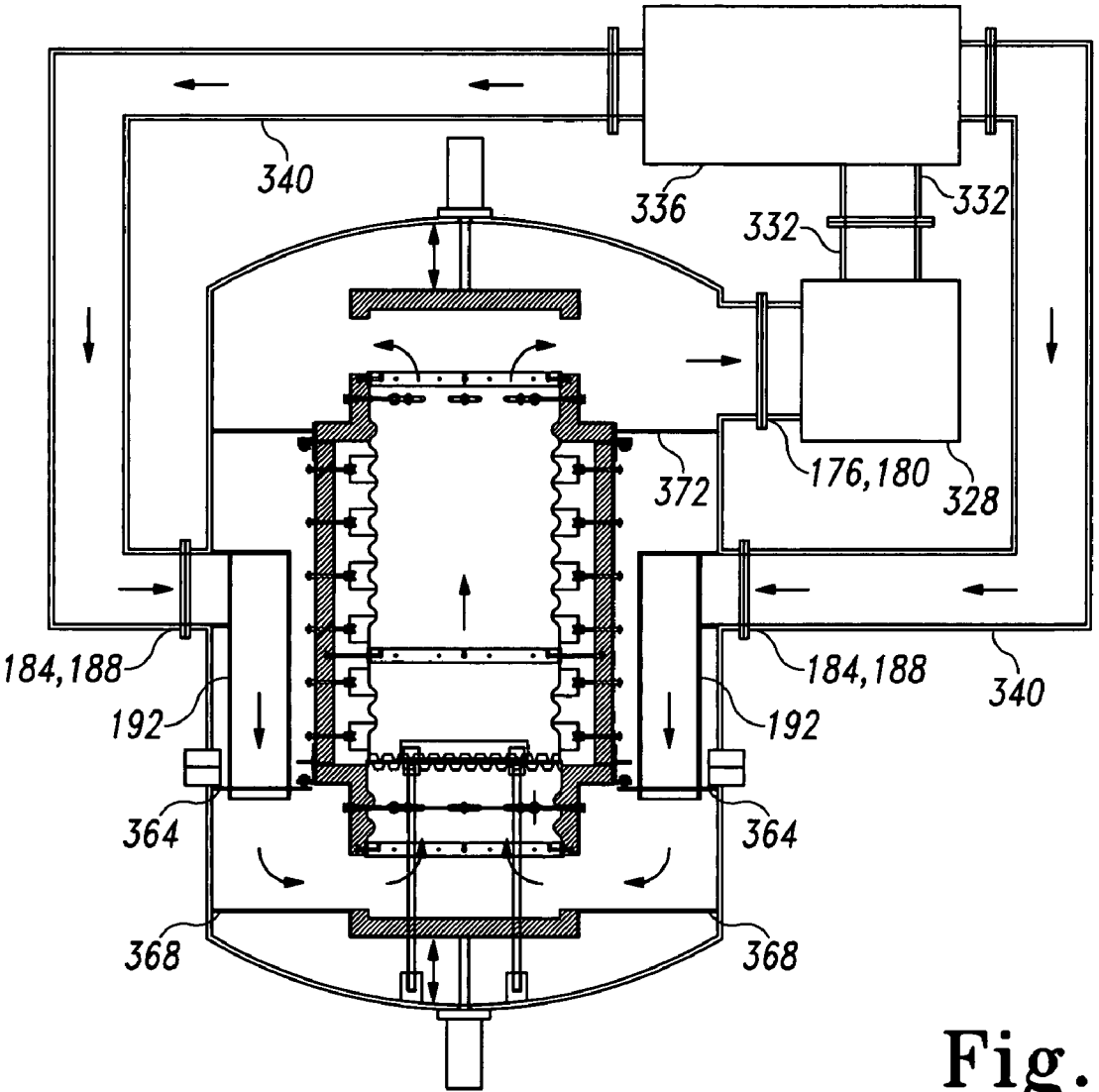
FIG. 37 shows a generally vertical vacuum furnace according to the invention in a cooling mode.
Figure 38:
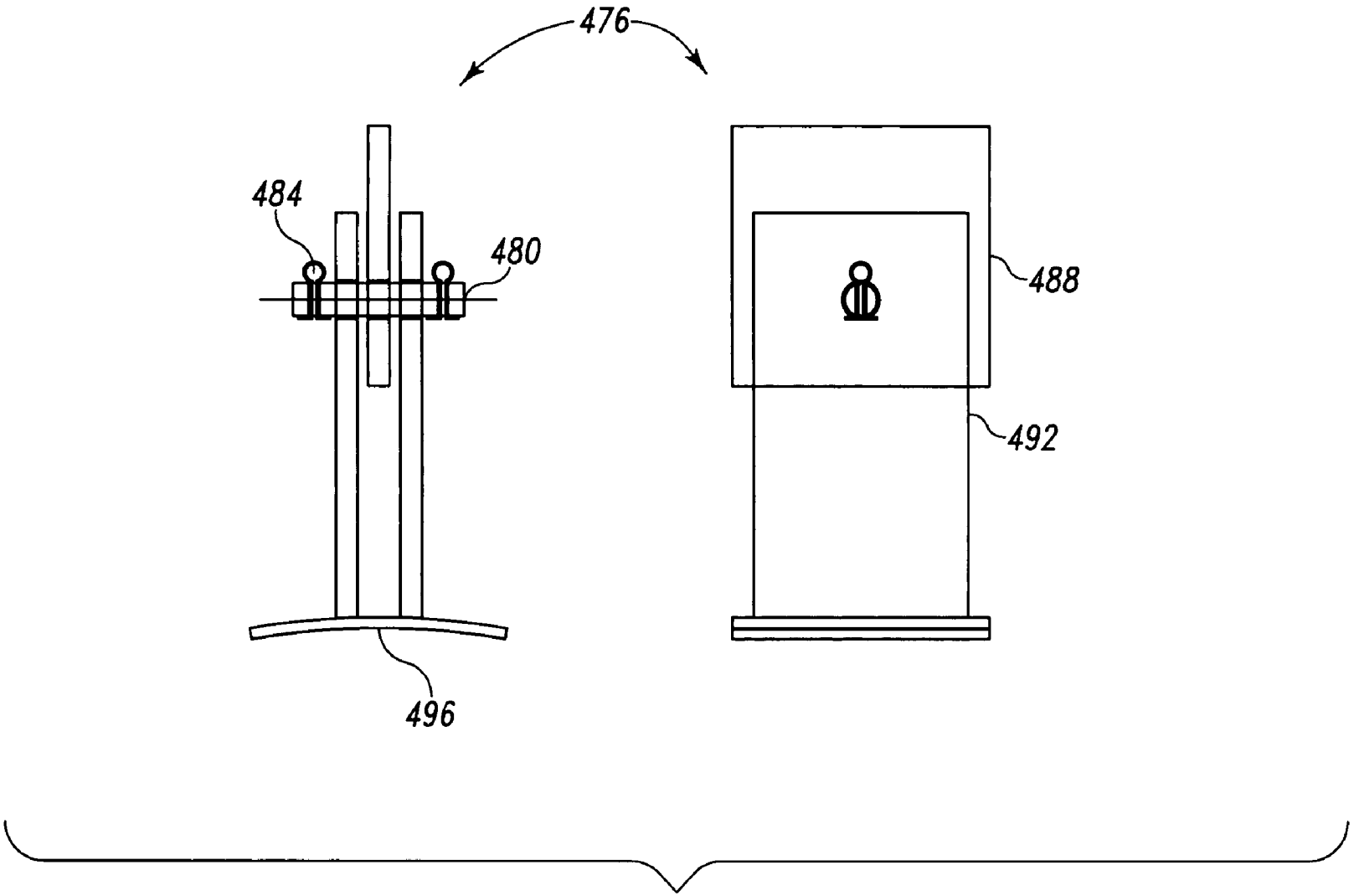
FIG. 38 shows a generally vertical hot zone support assembly.

Referring now primarily to FIG. 37, the generally vertical vacuum furnace is operable in a cooling mode. The cooling mode shown in FIG. 37 is analogous to the cooling mode shown in FIGS. 5 and 7 for the generally horizontal vacuum furnace. The generally vertical vacuum furnace is shown in a cooling mode. The term "cooling mode" is understood to include a particular functioning arrangement or condition that facilitates cooling of the load compared to other modes, such as for example a heating mode. The illustrated invention includes a high temperature fan and motor 328. The high temperature fan and motor 328 are preferably adapted to accommodate extreme temperatures. A hot gas piping 332 is provided in fluid communication with a heat exchanger 336. Any suitable heat exchanger 336 may be employed, though a water cooled shell and tube model may be considered. A cold gas return piping 340 is positioned as shown downstream of the heat exchanger 336. As indicated by the arrows, a suitable fluid moves though the muffle 72, and thus the load in the muffle, to cool the load. It should be noted that the fluid moves in a substantially unidirectional flow within the muffle. The fluid flows in a substantially unidirectional flow through the muffle.

It will be noted that the muffled end caps 400 are retracted, allowing for muffle fluid flow and thus cooling.

Without wishing to be bound by theory, the following aspects of certain embodiments of the invention may provide and/or enhance utility:

1. There is preferably no mass of a fan to be cooled as the load is quenched. Having a lower mass surrounding the load may improve the quenching rate.
2. Placing heating elements substantially inside the two ends of the muffle may give more uniform heating of the load. Heating of the load from more sides, preferably all sides, is particularly important for larger loads or in cases where the heating uniformity required is greater, such as aerospace applications and brazing.
3. The use of a duct to carry the fluid (which may be known as "cold" gas) past the main body of the hot zone to the door, and subsequently into the muffle, may reduce the heat gained by the fluid from the hot zone. The duct is preferably separated from the chamber in which the load is being heated and/or cooled.
4. The gas flow is generally axial and/or generally unidirectional inside the muffle.
5. The fan may be located externally to the muffle.
6. Some materials are constructed of refractory metals. The refractory metals include (but are not limited to) lanthanum doped molybdenum alloys, titanium zirconium alloys or molybdenum alloys depending upon the application.
7. The concept of using a turntable to rotate the load inside the muffle during cooling may reduce the differences in cooling rate between the front (relatively colder gas) end of the load and the rear (relatively hotter gas) end of the load.

Alternate embodiments may be employed and design advantages may be included. Rivets may be replaced by any other suitable fastener or joining means. A conventional vacuum furnace door with a fixed shield pack with elements and nozzles could be used. Also, gas could be admitted to the muffle thought an annular ring or set of slots in the vacuum furnace doors or thought openings in the side wall of the muffle. The mechanical arrangement of the vacuum furnace may be varied. The present design has the fan and heat exchanger located externally to the main vacuum chamber (which contains the hot zone). We are aware that the fan and heat exchanger could be located inside the main vacuum chamber. A vertical flow muffle could be made that is split vertically to allow for side loading, in addition to the of the bottom loading employed.

The muffle substantially confines the flowing cooling gas to cooling the parts, part of the load support assembly and the load. These parts are cooled by forced convection at a generally higher rate than a conventional vacuum furnace. The rest of the hot zone cools more slowly by natural convection and radiation. The load and the muffle may be cooled faster than the rest of the hot zone. This may lead to a longer hot zone life due to lower contraction rates and less gas erosion in the hot zone. The muffle allows for more uniform radiant heating than conventional vacuum furnace hot zones. The muffle exposes more of the load versus less with conventional band heating elements. The muffle evens out the variations in radiation intensity from the elements. The muffle allows generally more uniform heating of the load than use of heating elements alone.

The illustrated muffle is not gas tight. This feature may allow the muffle to be more lightweight. Lanthanum doped molybdenum or titanium zirconium molybdenum alloys may be used. Pure molybdenum may recrystallize and/or crack after a relatively short time in gas quenching service. The alloys may have a higher recrystallization temperature which is above the normal heat treating temperature range. The main portions of the hot zones may be single walled designs.

Any suitable and varying temperatures may be employed as required by the uses desired. The load may be subjected to temperatures of about 3,000 degrees Fahrenheit or other suitable temperatures or ranges. The load may be subjected to cooling by the fluid within the range of from about 140 to about 2,500 degrees Fahrenheit or other suitable temperatures or ranges. The muffle and the vacuum furnace may be oriented generally horizontally and/or generally vertically as desired.

In operation, the invention operates in cooling modes and heating modes. Means for cooling the load include the heat exchanger, the fan and/or a water jacket on the furnace chamber. The end cap(s) of the vacuum furnace is/are moveable to facilitate cooling or operation in a cooling mode. The cooling modes may employ one or more of the following steps, processes, or aspects;

1. Turn off heating element,
2. Fill chamber with fluid,
3. Open doors and/or turn on fan to circulate fluid. Backfill valves and exhaust components (not shown) may be employed as desired.

It will be appreciated that at least one of the means for heating the fluid is preferably located substantially within at least one end of the muffle. Likewise, the heating modes may employ one or more of the following steps, processes, or aspects;

1. Evacuate gas from chamber,
2. Close doors,
3. Turn on, activate, or turn up heating elements,
4. Circulate fluid as appropriate.

The principle and mode of operation of this invention have been described in specific embodiments. However, it should be noted that this invention may be practiced otherwise than as specifically illustrated and described without departing from its scope.

What is claimed is:

1. A vacuum furnace adapted to cool a load comprising:

an insulated hot zone shell located within a vacuum chamber;

a muffle located within the hot zone shell, the muffle having opposing open ends and substantially containing the load, the muffle comprised substantially of lanthanum doped molybdenum;

one or more heating means within the hot zone shell and substantially surrounding an exterior portion of the muffle;

a pair of doors located at each of the opposing open ends of the muffle, and a pair of end caps substantially in contact with each of the doors.

2. The vacuum furnace of claim 1 wherein the one or more means for heating the load is located substantially within at least one end of the muffle.

3. The vacuum furnace of claim 1 wherein the muffle is oriented generally horizontally.

4. The vacuum furnace of claim 1 wherein the muffle is oriented generally vertically.

5. The vacuum furnace of claim 1 wherein the one or more means for cooling a fluid is a heat exchanger.

6. The vacuum furnace of claim 1 further comprising a fan.

7. The vacuum furnace of claim 1 wherein the vacuum furnace includes an end cap.

8. The vacuum furnace of claim 7 wherein the end cap is moveable to facilitate cooling.

9. The vacuum furnace of claim 1 further comprising a duct separated from the chamber, wherein the fluid passes through the duct.

10. A vacuum furnace for heating a load comprising:

one or more means for heating the load; and a generally corrugated muffle substantially containing the load, the muffle comprised substantially of lanthanum doped molybdenum, wherein the one or more means for heating the load is substantially external to the muffle and a pressure interior to the muffle and a pressure exterior to the muffle are substantially similar.

11. The vacuum furnace of claim 10 further comprising a turntable to rotate the load.

12. The vacuum furnace of claim 10 wherein one of the or means for heating the load is located substantially within at least one end of the muffle.

13. The vacuum furnace of claim 10 wherein the muffle is oriented generally horizontally.

14. The vacuum furnace of claim 10 wherein the muffle is oriented generally vertically.

15. A vacuum furnace adapted to cool a load comprising:

one or more means for cooling a fluid; and a generally corrugated muffle substantially containing the load, the muffle comprised substantially of lanthanum doped molybdenum, wherein the fluid flows in a substantially unidirectional flow substantially within the muffle.

16. A vacuum furnace for heating a load comprising:

one or more means for heating the load; and a generally corrugated muffle substantially containing the load, the muffle comprised substantially of lanthanum doped molybdenum, wherein the one or more means for heating the load is substantially external to the muffle.

17. A vacuum furnace adapted to cool a load comprising:

one or more means for cooling a fluid; and a muffle having an inner sleeve and an outer sleeve and substantially containing the load, wherein the muffle is substantially made of a lanthanum doped molybdenum alloy.

* * * * *